United States Patent [19]

Yamashita et al.

[11] Patent Number: 4,461,826

[45] Date of Patent: Jul. 24, 1984

[54] LIGHT-SENSITIVE COLOR PHOTOGRAPHIC MATERIAL

[75] Inventors: Kiyoshi Yamashita; Toshifumi Iijima, both of Hino, Japan

[73] Assignee: Konishiroku Photo Industry Co., Ltd., Tokyo, Japan

[21] Appl. No.: 397,084

[22] Filed: Jul. 12, 1982

[30] Foreign Application Priority Data

| | | | |
|---|---|---|---|
| Jul. 10, 1981 | [JP] | Japan | 56-106908 |
| Dec. 11, 1981 | [JP] | Japan | 56-200477 |
| Dec. 12, 1981 | [JP] | Japan | 56-200611 |

[51] Int. Cl.[3] ..... G03C 1/46; G03C 1/02

[52] U.S. Cl. ..... 430/505; 430/502; 430/503; 430/506; 430/509; 430/544; 430/567; 430/957

[58] Field of Search ..... 430/502, 503, 505, 506, 430/509, 567, 569, 957, 544

[56] References Cited

U.S. PATENT DOCUMENTS

| | | | |
|---|---|---|---|
| 4,153,460 | 5/1979 | Iijima et al. | 430/505 |
| 4,248,962 | 2/1981 | Lau | 430/957 |
| 4,269,927 | 5/1981 | Atwell | 430/567 |

*Primary Examiner*—Mary F. Downey

*Attorney, Agent, or Firm*—Frishauf, Holtz, Goodman & Woodward

[57] ABSTRACT

There is disclosed a silver halide light-sensitive color photographic material which comprises a support and coated thereon a light-sensitive layer containing a compound which, upon reaction with an oxidized color developing agent, is capable of releasing a diffusible development inhibitor and a negative type light-sensitive silver halide emulsion containing light-sensitive silver halide crystals essentially consisting of mono-dispersed silver halide crystals of which size distribution satisfies the following relation:

$S/\bar{r} \leqq 0.15$ wherein $S=\sqrt{\Sigma(r-r_i)^2 n_i^2/\Sigma n_i}$ and $\bar{r}=\Sigma n_i r_i/\Sigma n_i$ in which $r_i$ represents the crystal size of individual silver halide crystals and $n_i$ represents the number of crystals.

The light-sensitive color photographic material of the present invention provides an image of remarkably improved sharpness.

20 Claims, No Drawings

LIGHT-SENSITIVE COLOR PHOTOGRAPHIC MATERIAL

This invention relates to a silver halide light-sensitive color photographic material, and more particularly to a novel silver halide light-sensitive color photographic material exhibiting an improved image sharpness.

Generally, in the case of a multi-layer light-sensitive color photographic material, it is required that the image contour is sharp and a small image is expressed clearly, namely the image sharpness be high. Particularly, a negative type light-sensitive color photographic material used as an intermediate medium for obtaining an enlarged printed image is requested to exhibit a high sharpness corresponding to the enlarged magnification. This requirement is recently strengthened as the cameras become smaller and the size of the image formed on the color photographic material has been reduced.

For the purpose of improving the sharpness, it has been proposed in Japanese Provisional Patent Publication Nos. 117032/1976 and 115219/1976 to reduce the amount of the silver halides by using a novel two-equivalent coupler. It has also been proposed in Japanese Patent Publication No. 26134/1974 to add substantially insensitive silver halides having a size of 0.2$\mu$ or less to a silver halide emulsion having an average crystal size between 0.3$\mu$ and 3$\mu$. Further, it is disclosed in U.S. Pat. No. 3,658,536 to position part of the blue-sensitive emulsion layer below the green- or red-sensitive emulsion layer, thereby minimizing the influence of light scattering on the green- or red-sensitive layer and improving the sharpness. It has also been proposed in Japanese Patent Publication No. 37018/1978 to apply part of the green-sensitive layer as the uppermost layer. On the other hand, as described in Japanese Provisional Patent Publication Nos. 139522/1978 and 77327/1976, an acid dye is used for a light-sensitive material for 8 mm movie films as an irradiation preventing dye for improving the sharpness. It is also known to improve the sharpness by providing an antihalation coating as described in Japanese Provisional Patent Publication Nos. 46133/1975, 117122/1977 and 5624/1978. These techniques intend to achieve an improvement in the high frequency region in the modulation transfer function (MTF) curve by reducing the light scattering in the lateral direction. These known techniques can considerably improve the sharpness, but are disadvantageous for example in that desensitization occurs because an irradiation preventing dye or an antihalation coating is used.

It is also known that the sharpness can be improved by utilizing the adjacency effect of a certain diffusing substance which is released during development. This effect occurs due to a partial change in density i.e., density inclination of the diffusing development inhibitor, which is released during development, in the light-sensitive color photographic material. To achieve this, the developing solution is diluted with water, agitation is conducted slightly during development, or a compound releasing a diffusing type of development inhibitor by reacting with an oxidized product of the developing agent is contained in the light-sensitive material. Examples of known compounds releasing a diffusing development inhibitor by the reaction with an oxidized product of the developing agent are compounds which couple with an oxidized product of a color developing agent to form a dye and release a development inhibitor (hereinafter referred to as the DIR couplers) as disclosed in U.S. Pat. No. 3,148,062, and compounds which release a development inbhibitor without forming a dye by the coupling with an oxidized product of a color developing agent (hereinafter referred to as the DIR substances) as disclosed in U.S. Pat. No. 3,632,345. (Both DIR couplers and DIR substances are referred to as the DIR compounds).

The adjacency effects of the diffusing development inhibitors released during development are described in many publications including the above-mentioned U.S. Patents.

Further, Japanese Provisional Patent Publication Nos. 82424/1977 and 117627/1977 disclose novel DIR couplers which can improve the color reproducibility and sharpness. However, these publications do not describe a technique for deriving the maximum sharpness improvement effect of the DIR couplers. As described above, although it is known that the adjacency effect of the diffusing development inhibitor released during development enhances the sharpness, the degree of improvement in the sharpness is still unsatisfactory, and a need exists for a further improvement in the sharpness.

The primary object of the present invention is to provide a silver halide light-sensitive color photographic material exhibiting a remarkably improved sharpness. Another object of the present invention is to provide a silver halide light-sensitive color photographic material exhibiting an enhanced adjacency effect of the diffusing development inhibitor released during development by use of the DIR compounds.

Other objects of the present invention will be clarified by the descriptions below.

Thus the present invention more specifically relates to a silver halide light-sensitive color photographic material which comprises a support and coated thereon a light-sensitive layer containing a compound which, upon reaction with an oxidized color developing agent, is capable of releasing a diffusible development inhibitor and a negative type light-sensitive silver halide emulsion containing light-sensitive silver halide crystals essentially consisting of monodispersed silver halide crystals having a size distribution which satisfies the following relationship:

$S/\bar{r} \leqq 0.15$ wherein $S=\sqrt{\Sigma(\bar{r}-r_i)^2 n_i^2/\Sigma n_i}$ and $\bar{r}=\Sigma n_i r_i/\Sigma n_i$ in which $r_1$ represents the crystal size of individual silver halide crystals and $n_i$ represents the number of crystals.

In the present invention, the term "negative type silver halide emulsion" is used in terms of the term contrary to so-called "direct positive emulsion"; in other words the negative type silver halide emulsion means such an emulsion that produces a silver image when exposed and then developed with a surface developing agent reciprocally proportional to the luminous intensity of the object.

The present invention is characterized by enhancing the edge effect, namely the difference in the adjacency effect of the diffusing development inhibitor released during the development with respect to the exposed area at the boundary between the exposed and unexposed areas.

The inventors studied the advantages and utility of the use of DIR compounds and have found that the edge effect can be enhanced and the sharpness can be improved to a higher degree as the difference between the gamma ($\gamma$) values of the color images obtained by the color development in the area where a diffusing development inhibitor is released and in the area where it is not released during the color development increases. The gamma ($\gamma$) is a characteristic indicating the tone of the photographic material, as defined in "Shashin Kagaku" (Photographic Chemistry) by Shin-ichi Kikuchi, Kyoritsu Shuppan, page 90.

Normally, silver halide color photograhic materials have gamma values suitable for their applications. In order to obtain a desired gamma value and yet increase the difference between the gamma characteristics of the color images obtained by the color development in the area where a diffusing development inhibitor is released and in the area where it is not released during the color development, it is necessary to increase the gamma value in the area where the diffusing development inhibitor is not released.

The inventors further studied to increase the gamma value of an emulsion containing no DIR compound, and have found that an emulsion having a higher gamma value can be obtained if the uniformity of the crystal size in the emulsion is increased.

In the past, it was the general practice to add a DIR compound to the emulsion so as to obtain desired gamma characteristics in the silver halide color photographic material. However, it is difficult to control the gamma characteristics with a DIR compound if the gamma value of the emulsion before the addition of the DIR compound is high and, therefore, it is difficult to produce a silver halide light-sensitive photographic material exhibiting a wide latitude of exposure with good linearity. Further, desensitization occurs because the amount of the DIR compound used must be increased. For these reasons, in the conventional silver halide light-sensitive material, it was impossible to increase the gamma value of the emulsion containing no DIR compound.

Further, a negative type silver halide light-sensitive color photographic material for taking a picture, which contains an emulsion having uniform crystal size, was not put into practical use for the reason that, with such an emulsion, a desired gamma characteristic cannot be obtained without adversely affecting the photographic characteristics other than gamma.

However, it has been unexpectedly found that, if the crystal size of the emulsion is uniform, it is possible to obtain a desired gamma characteristics and considerably improve the sharpness without causing desensitization even when the amount of the DIR compound is increased for the purpose of obtaining a desired gamma characteristic.

Namely, it has been found that, as the uniformity of the crystal size of the emulsion increases, it becomes possible to increase the difference between the gamma characteristics of the color images in the area where a diffusing development inhibitor is released during the color development and in the area where it is not released, without adversely affecting the photographic characteristics such as desensitization, and to improve the sharpness to a higher degree.

In the present invention, the monodispersed emulsion means an emulsion containing light-sensitive silver halide crystals essentially consisting of such crystals in which the ratio of the standard deviation S (defined below) against the average crystal size $\bar{r}$ is not greater than 0.15:

$$S = \frac{\sqrt{\Sigma(\bar{r} - r_i)^2 n_i^2}}{\Sigma n_i}$$

In the present invention a monodispersed emulsion having the ratio of 0.10 or less is preferable in view of obtaining more enhanced sharpness effect.

The average crystal size $\bar{r}$ in the present invention means the average diameter of silver halide crystals when they are spherical. When the crystal are not spherical, their projected images are converted to circular images of the same area, and the average of the diameters of the circular images is taken as the average grain size. The average crystal size is defined by:

$$\bar{r} = \frac{\Sigma n_i r_i}{\Sigma n_i}$$

where $r_i$ designates the crystal sizes of individual crystals and $n_i$ designates the number of crystals. In the present invention, the average grain size $\bar{r}$ is preferably between 0.3$\mu$ and 1.5$\mu$.

For the purpose of widening the exposure latitude, two or more emulsions having different average crystal sizes may be mixed together. In the present invention, it is preferable that two or more kinds of monodispersed emulsions which are adequately sensitized respectively may be used in admixture with one another.

The effects of the present invention increase as the uniformity of the crystal size distribution of the silver halide crystals in the emulsion increases. This is presumably attributable to the fact that the photographic characteristics such as light sensitivity and development characteristics of each crystal are uniform and, therefore, the crystals can uniformly receive the development inhibiting action of the diffusing development inhibitor released from the DIR compound during the color development.

The silver halide crystals used in the present invention may be the so-called twinned crystals having irregular crystal habit such as a plate-like shape, or may be of a regular crystal habit such as cube, octahedron, tetradecahedron and sphere as far as the size distribution of the crystals satisfy above-mentioned relation. Preferably, those having regular crystal habit, especially, octahedral and/or tetradecahedral shaped crystals can be used. The silver halide crystals may be of the so-called core-shell type in which the photographic characteristics and/or the silver halide composition differ between the core and the shell portions of the crystal.

The silver halide crystals of the invention may consist of silver chloride, silver bromide, silver iodide, or a combination thereof such as silver chlorobromide, silver iodobromide, silver chloroiodide, silver chloroiodobromide or the like. Preferably, the silver iodobromide crystals are used.

In the present invention, it is sufficient that the silver halide color photographic material has at least one silver halide light-sensitive emulsion layer containing at least one DIR compound and a silver halide light-sensitive emulsion which is a monodispersed emulsion or a mixture of monodispersed emulsions.

In the silver halide light-sensitive color photographic material according to the present invention, it is preferable that each emulsion layer containing negative type silver halide crystals having the same spectral sensitivity is constituted by at least two negative type silver halide emulsion layers having different light sensitivities.

It is preferable that the upper layer, viewed from the substrate, has a light sensitivity higher than that of the lower layer. Further, in the present invention, it is preferable that the at least two layers each having the same spectral sensitivity have the average crystal sizes of the silver halide crystals different from each other. For example, it is preferable that the average crystal size of the silver halide crystals contained in the emulsion layer having a higher light sensitivity is in the range between 0.5$\mu$ and 1.5$\mu$, while that in the emulsion layer having a lower light sensitivity is in the range between 0.3$\mu$ and 0.8$\mu$.

According to one of the preferable embodiments, the present invention is applied to an ordinary multi-layer light-sensitive color photographic material containing a blue-, green- and red-sensitive emulsion layers, wherein at least one of these layers satisfies the conditions mentioned above. Particularly, it is preferable that at least the green-sensitive emulsion layer satisfies the aforesaid conditions in the light of relative luminosity curve of the human eye; i.e., the eye of a person has the highest sensitivity to green light among the visible rays. Further, when the blue-, green- and red-sensitive emulsion layers respectively comprise a plurality of layers having different sensitivities, it is preferable that at least one of the layers satisfies the aforesaid conditions, and more preferably at least the emulsion having a lower sensitivity satisfy the aforesaid conditions. According to the most preferable embodiment of the present invention all of the blue-, green- and red-sensitive layers satisfy the aforesaid conditions.

The DIR compounds used in the present invention are represented by the following general formula (A) or (B):

A—TIME—Z (A)

In the general formula (A), A designates a coupling component capable of reacting with an oxidized product of a color developing agent. The coupling component may be any component which can release the group TIME—Z by the reaction with an oxidized product of a color developing agent.

In the general formula (A), TIME designates a timing group, and Z designates a development inhibitor. Examples of TIME includes those based on the intramolecular nucleophilic substitution as described in Japanese Provisional Patent Publication No. 145135/1979, and those based on the electron movement along the conjugated chain as described in Japanese Provisional Patent Publication No. 114946/1971. In short, any compound may be used if it first releases the group TIME—Z through the breakage of the A—TIME bond and then releases Z through the breakage of the TIME—Z bond. Z includes the development inhibitors as described in "Research Disclosure", Vol. 176, No. 17643, December 1978 (hereinafter referred to as the literature 1). Preferably, it is mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole or a derivative thereof.

Among those DIR compounds represented by the formula (B), those represented by formulas [1] to [3] can be mentioned as preferable ones in the present invention:

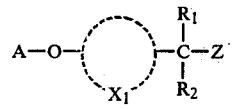

[1]

where A represents a residue capable of releasing Z upon reaction with an oxidized product of a color developing agent; Z represents a split-off residue which, upon reaction of the compound with the oxidized color developing agent, forms a development inhibitor; $X_1$ represents a phenylene or naphthylene group each of which may be substituted; and $R_1$ and $R_2$ independently represent a hydrogen atom, an alkyl or aryl group,

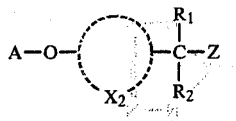

[2]

wherein A, Z, $R_1$ and $R_2$ respectively represent the same atoms, groups or residues as defined in the above formula [1]; and $X_2$ represents a group of atoms necessary to form a divalent pyrazole-di-yl group which may be substituted A—Nu—Y—E—Z [3]

wherein A and Z respectively represent the same residues as defined in the above formula [1]; Nu represents a nucleophilic group containing an oxygen, sulphur or nitrogen atom; Y represents a divalent group which is capable of causing under alkaline condition an intramolecular nucleophilic substitution reaction by forming a three-membered or five-membered ring and thus is capable of releasing Z after the release of —Nu—Y—E—Z from A; and E represents an electrophilic group containing a carbonyl, thiocarbonyl, phosphinyl or thiophosphinyl group.

A—Z (B)

In the general formula (B), A and Z have the same meanings as described above with respect to the general formula [1].

Syntheses of the compounds represented by the general formula (A) are described for example in Japanese Provisional Patent Publication No. 14513/1979 and Japanese Provisional Patent Publication No. 114946/1981.

The DIR compounds represented by the general formula [2] involve the DIR couplers and the DIR substances. Examples of the DIR couplers represented by the general formula [2] are described e.g. in U.S. Pat. Nos. 3,227,554 and 3,773,201, and British Pat. No. 2,010,818. Syntheses thereof are also described in these patents.

Examples of the DIR substances represented by the general formula (B) are described e.g. in U.S. Pat. Nos. 3,958,993, 3,961,959 and 3,938,996, Japanese Provisional Patent Publication Nos. 147716/1975, 152731/1975, 105819/1976, 6724/1976, 46817/1977, and 49030/1977 and U.S. Pat. Nos. 3,928,041 and 3,632,345. Syntheses thereof are also described in these specifications.

Examples of these compounds are shown below. However, the compounds used in the present invention are not limited to these compounds.

Examples of the compounds

[D - 1]

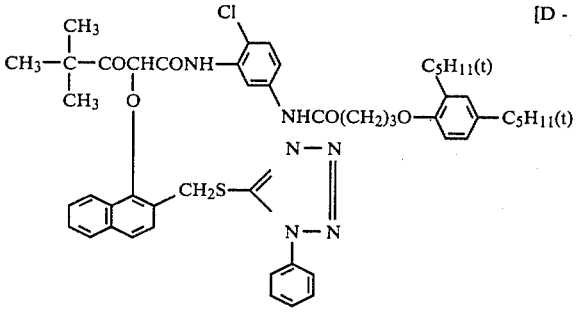

[D - 2]

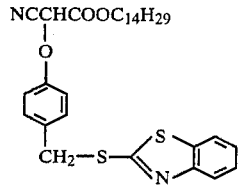

[D - 3]

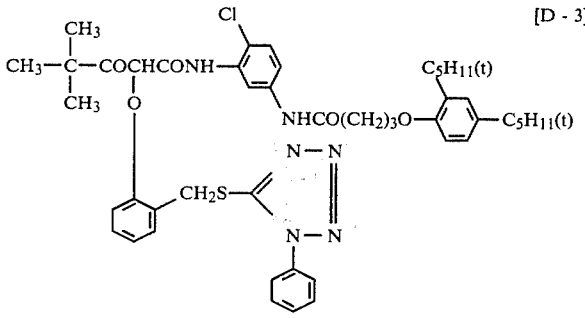

[D - 4]

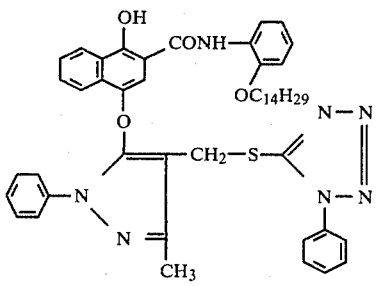

-continued
[D - 5]
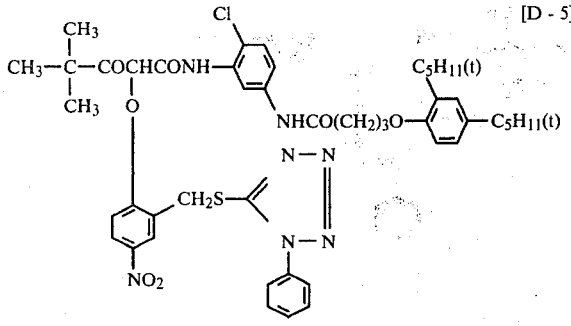
[D - 6]
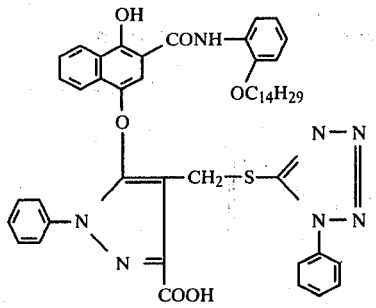
[D - 7]
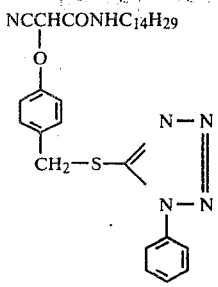
[D - 8]
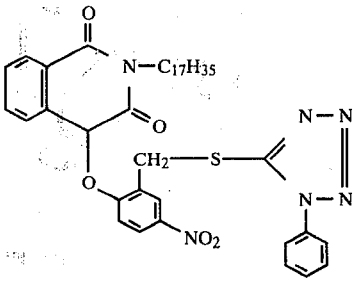
[D - 9]
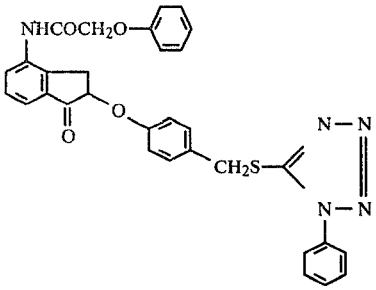
[D - 10]
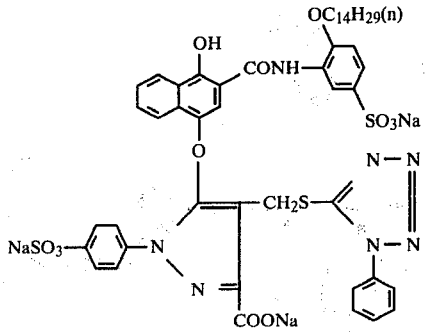
[D - 11]
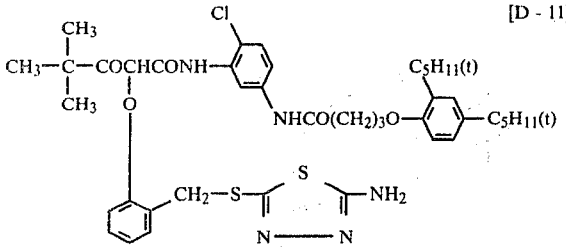
[D - 12]
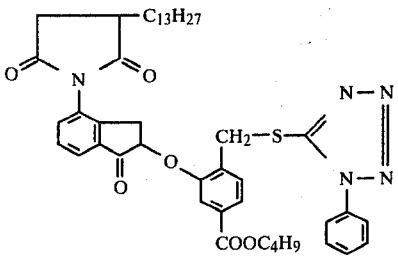

-continued
[D - 13]
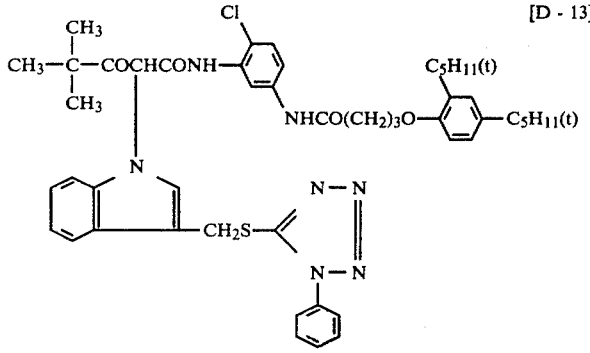
[D - 14]
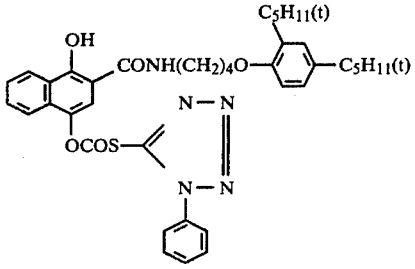
[D - 15]
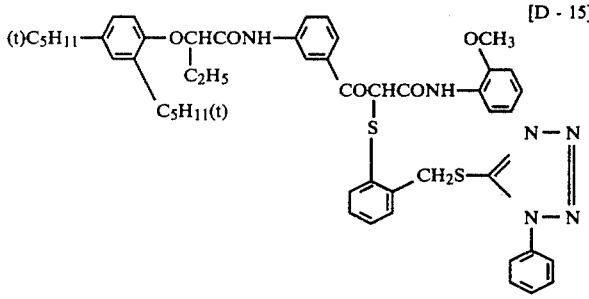
[D - 16]
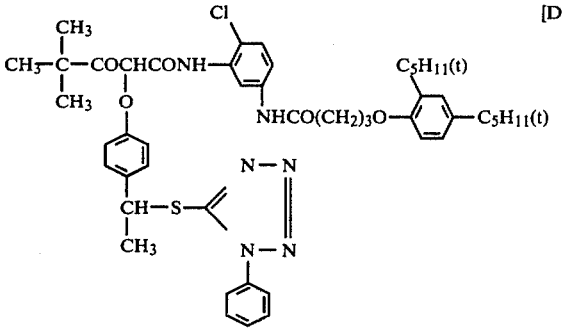
[D - 17]
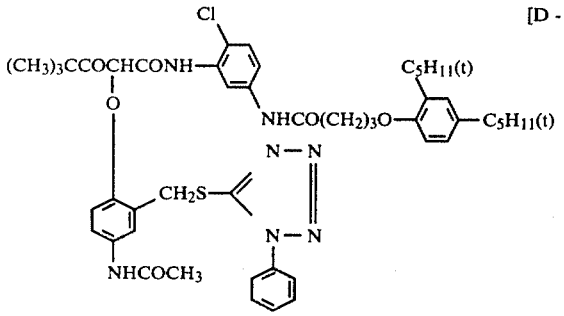
[D - 18]
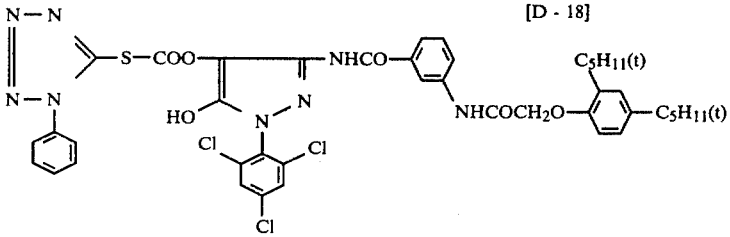
[D - 19]
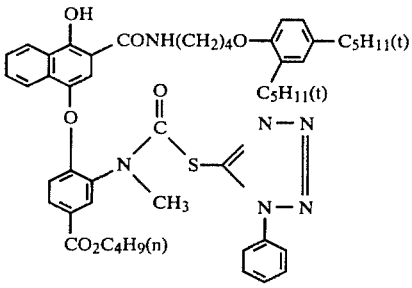
[D - 20]
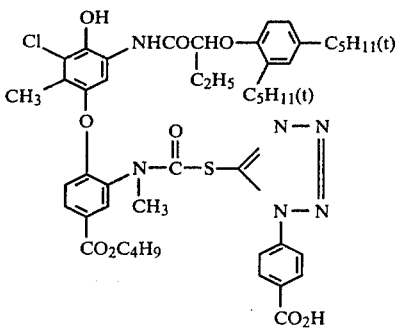

-continued

[D - 21]

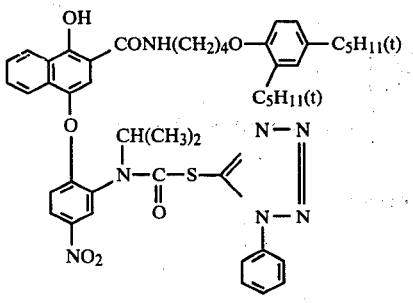

[D - 22]

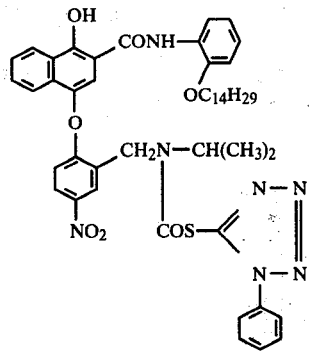

[D - 23]

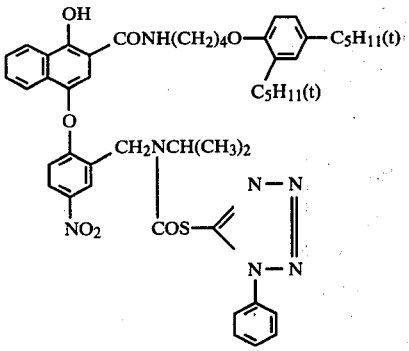

[D - 24]~[D - 31]

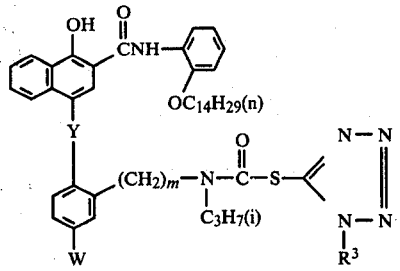

In the formula for [D-24]~[D-31], Y, W, m and $R^3$ each represent the following:

| Compound No. | Y | W | m | $R_3$ |
|---|---|---|---|---|
| [D - 24] | O | $NO_2$ | 0 | 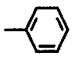 |
| [D - 25] | S | $NO_2$ | 1 | 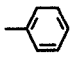 |
| [D - 26] | O | $NO_2$ | 1 | 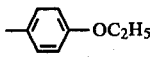 |
| [D - 27] | O | $NO_2$ | 1 | 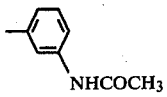 |
| [D - 28] | O | $NO_2$ | 1 | 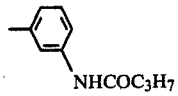 |
| [D - 29] | O | $-NHSO_2C_4H_9$ | 0 | 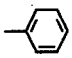 |

-continued

| Compound No. | Y | W | m | $R_3$ |
|---|---|---|---|---|
| [D - 30] | O | $-NHSO_2C_8H_{17}$ | 1 | 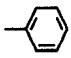 |
| [D - 31] | S | H | 0 | 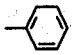 |
| [D - 32]~[D - 36] | 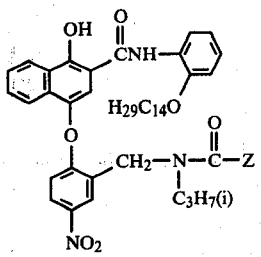 | | | |

In [D-32]~[D-36], Z represents the following:

| Compound No. | |
|---|---|
| [D - 32] | ethylthiotetrazole |
| [D - 33] | n-butylthiotetrazole |
| [D - 34] | cyclohexylthiotetrazole |
| [D - 35] | N—butylthiotetrazole |
| [D - 36] | 5,6-dichlorobenzotriazole |

[D - 37]
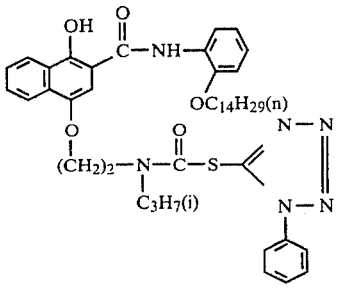
[D - 38]
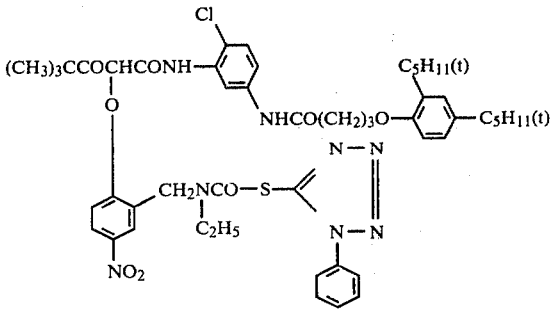
[D - 39]
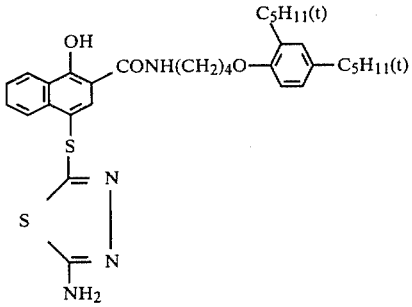
[D - 40]
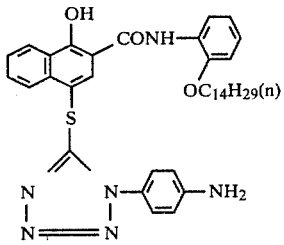
[D - 41]
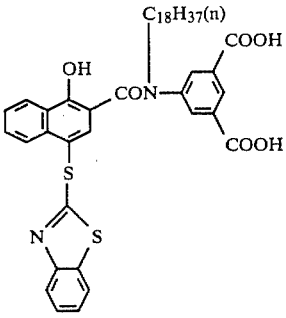
[D - 42]
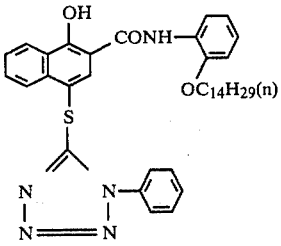
[D - 43]
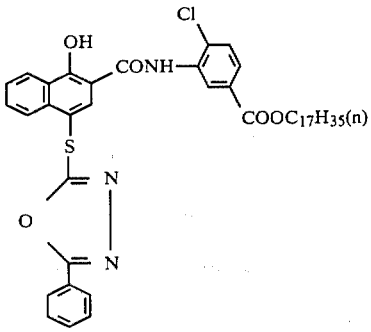
[D - 44]
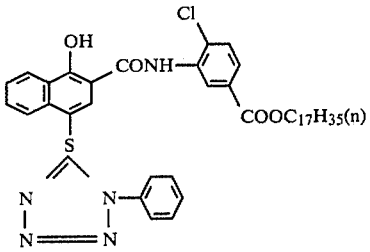
[D - 45]
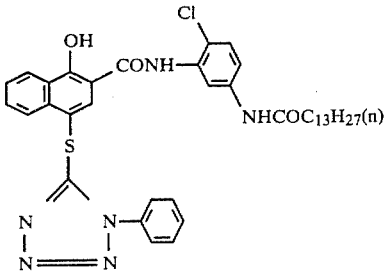
[D - 46]
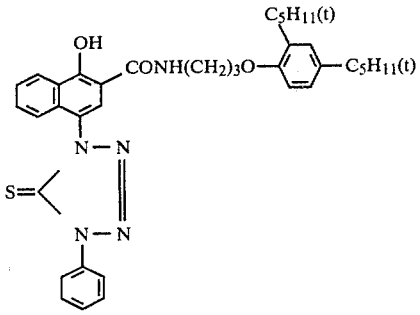

-continued
[D - 47]
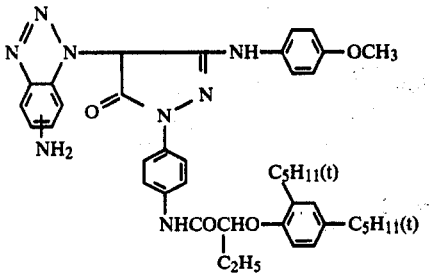
[D - 48]
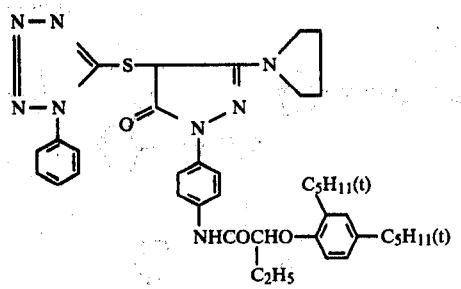
[D - 49]
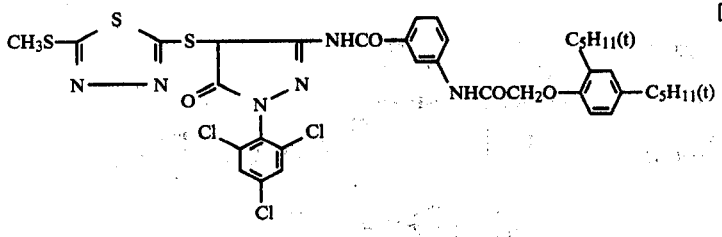
[D - 50]
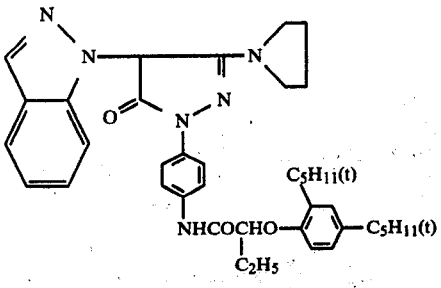
[D - 51]
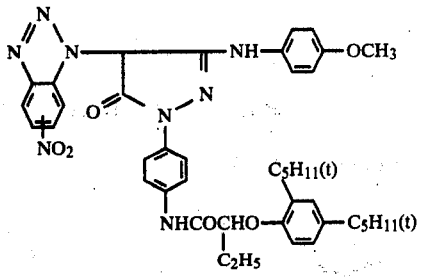
[D - 52]
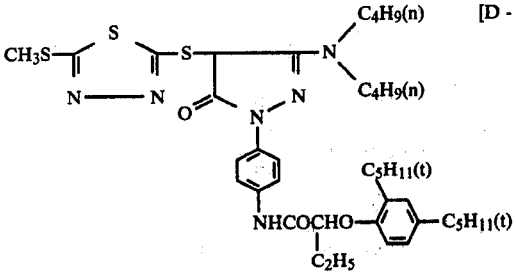
[D - 53]
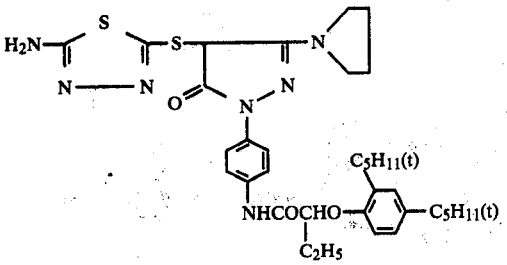
[D - 54]
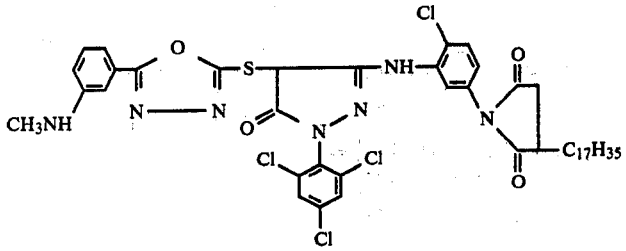
[D - 55]
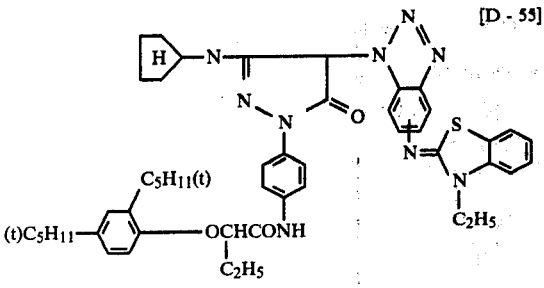
[D - 56]
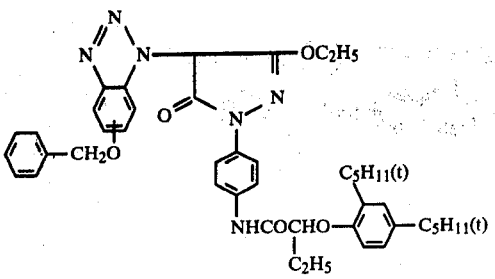

-continued
[D - 57]
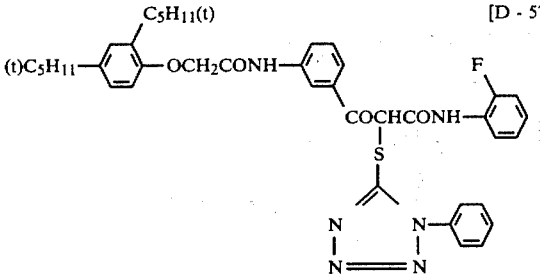
[D - 58]
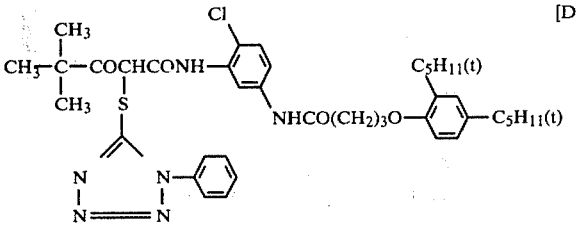
[D - 59]
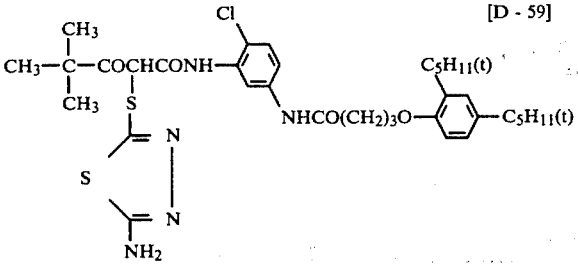
[D - 60]
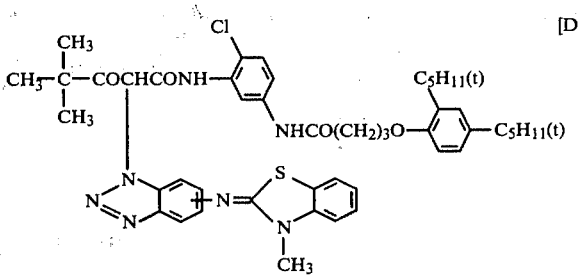
[D - 61]
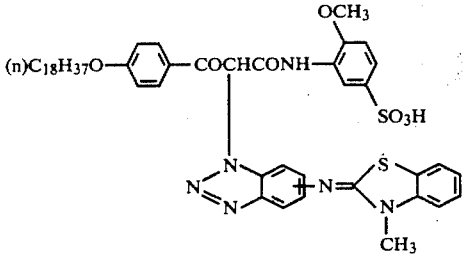
[D - 62]
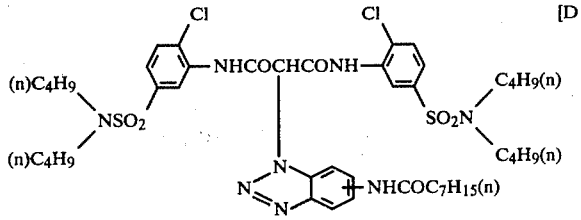
[D - 63]
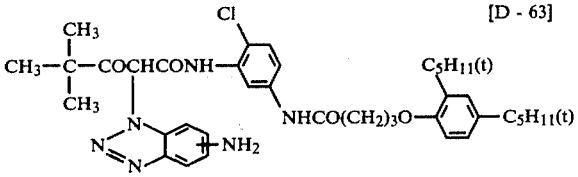
[D - 64]
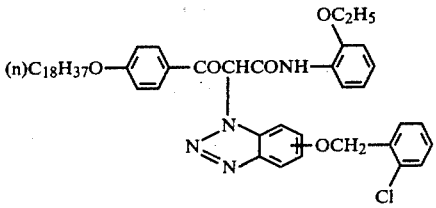
[D - 65]
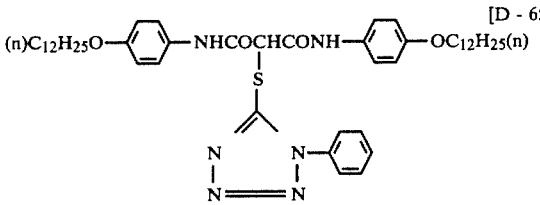
[D - 66]
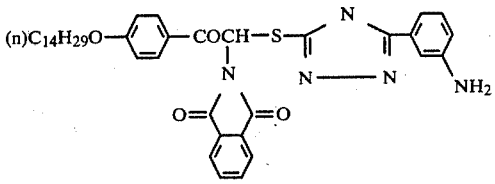
[D - 67]
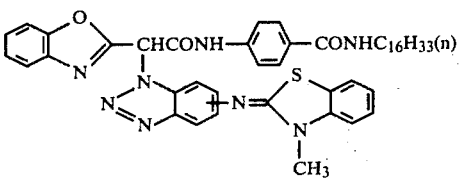
[D - 68]
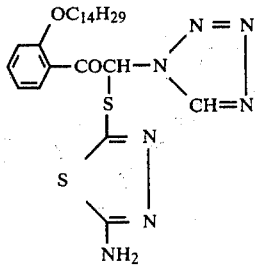

-continued
[D - 69]
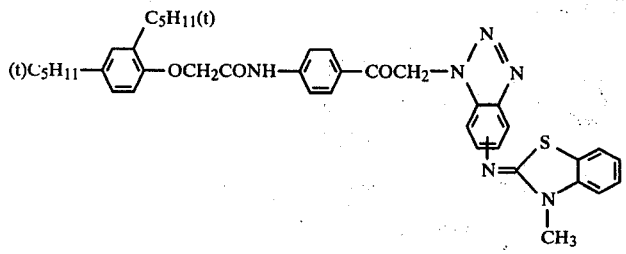
[D - 70]
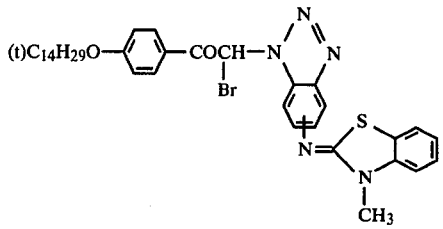
[D - 71]
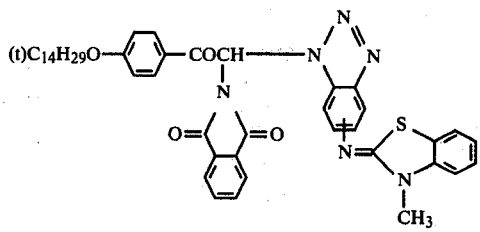
[D - 72]
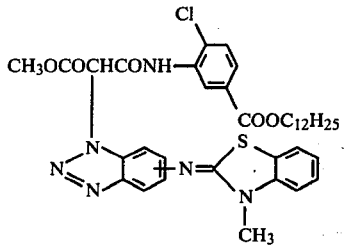
[D - 73]
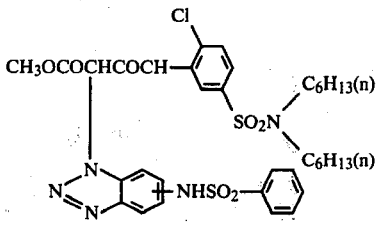
[D - 74]
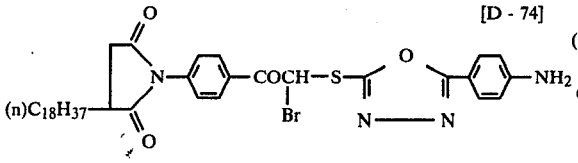
[D - 75]
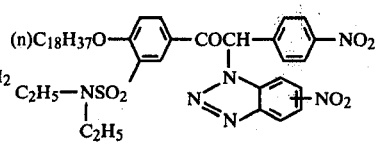
[D - 76]
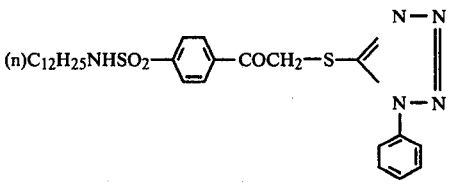
[D - 77]
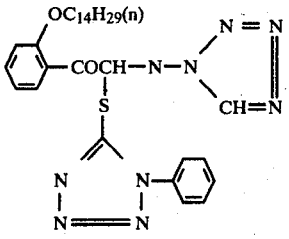
[D - 78]
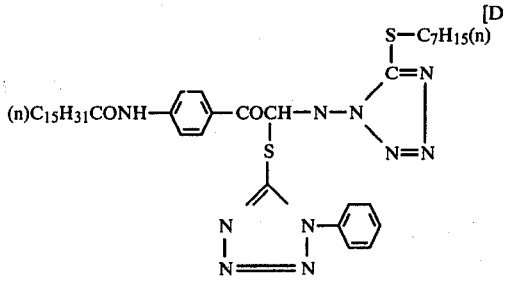
[D - 79]
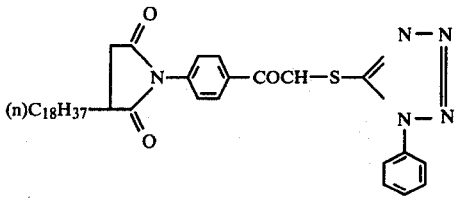
[D - 80]
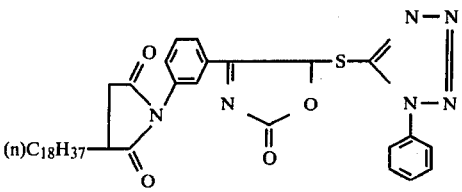
[D - 81]
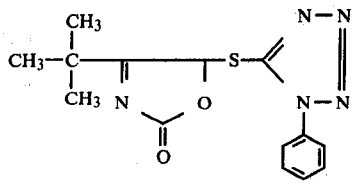

-continued
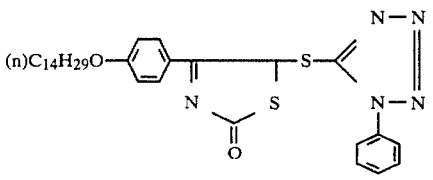
[D - 82]
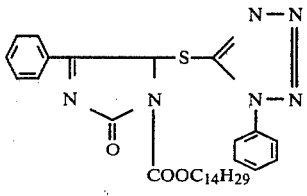
[D - 83]
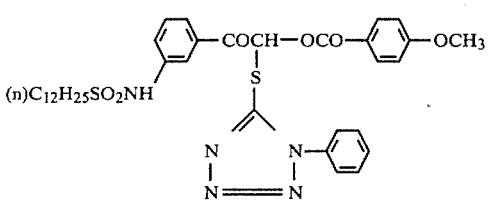
[D - 84]
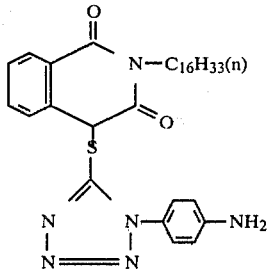
[D - 85]
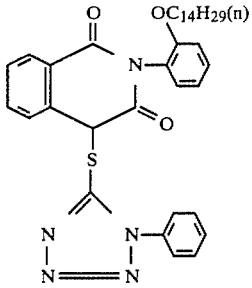
[D - 86]
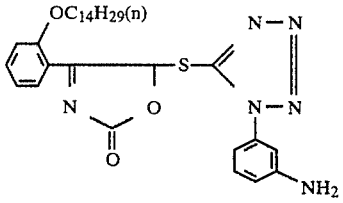
[D - 87]
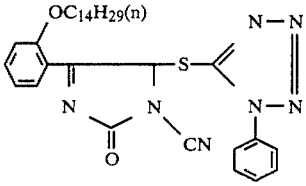
[D - 88]
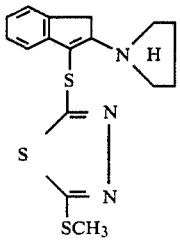
[D - 89]
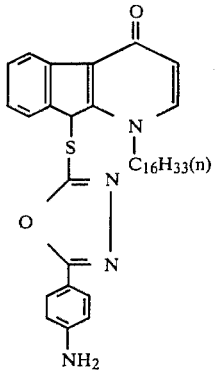
[D - 90]
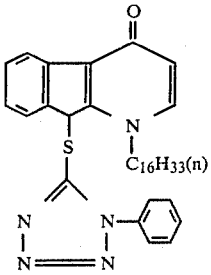
[D - 91]

-continued
[D - 92]
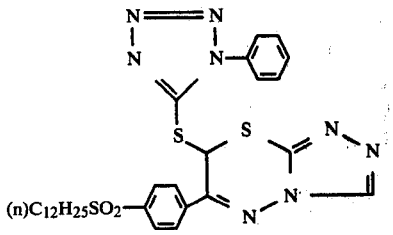
[D - 93]
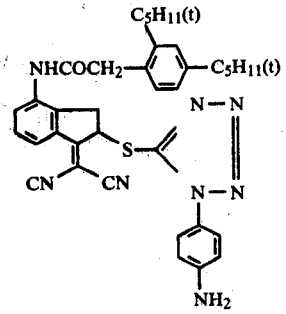
[D - 94]
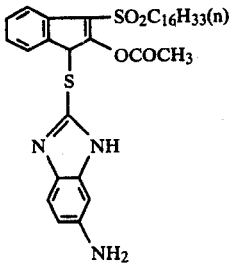
[D - 95]
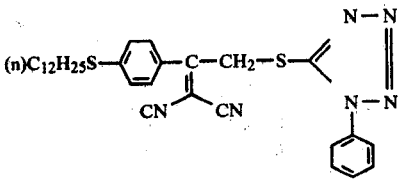
[D - 96]
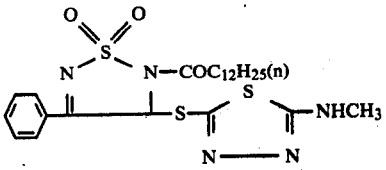
[D - 97]
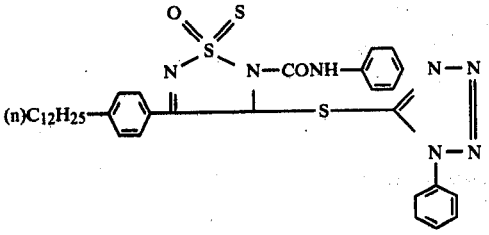
[D - 98]
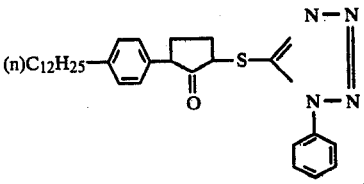
[D - 99]
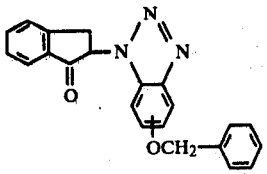
[D - 100]
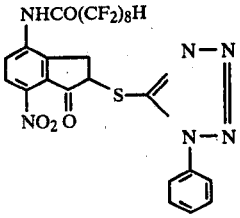
[D - 101]
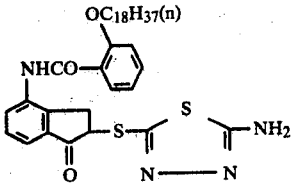
[D - 102]
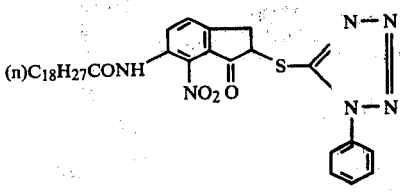
[D - 103]
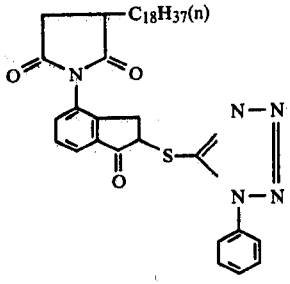

-continued
[D - 104]
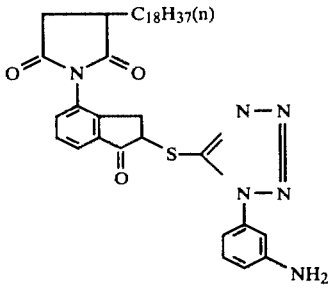
[D - 105]
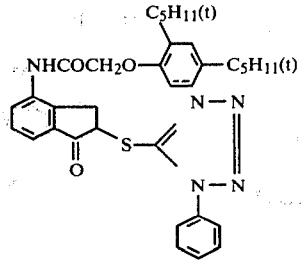
[D - 106]
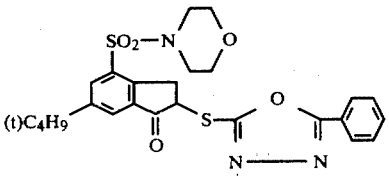
[D - 107]
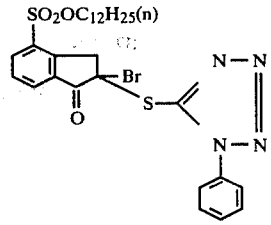
[D - 108]
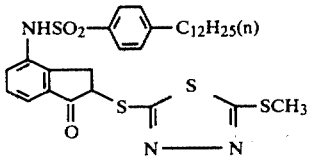
[D - 109]
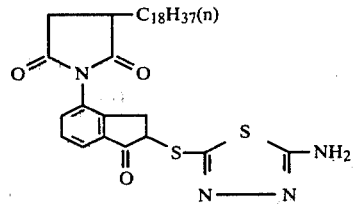
[D - 110]
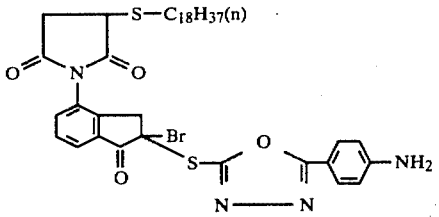
[D - 111]
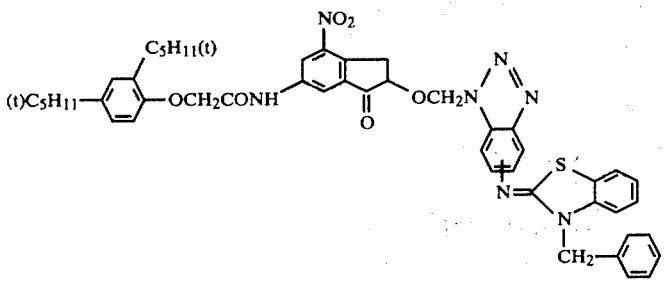
[D - 112]
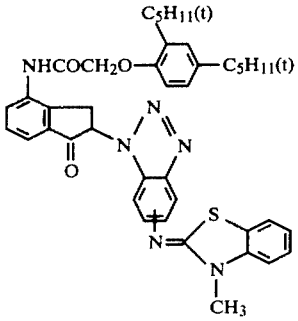
[D - 113]
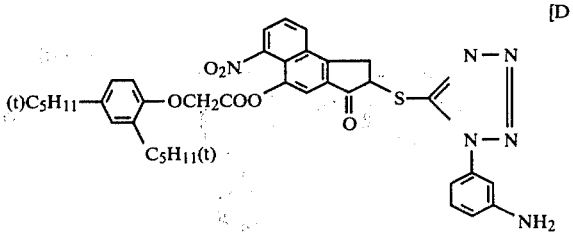

-continued

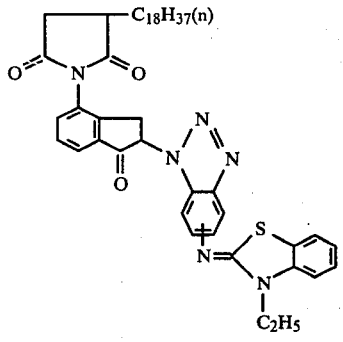

[D - 114]

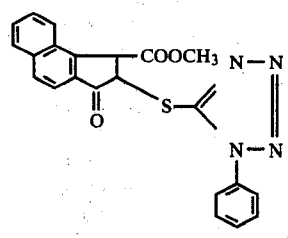

[D - 115]

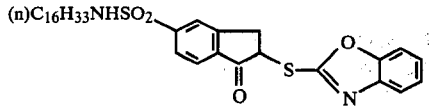

[D - 116]

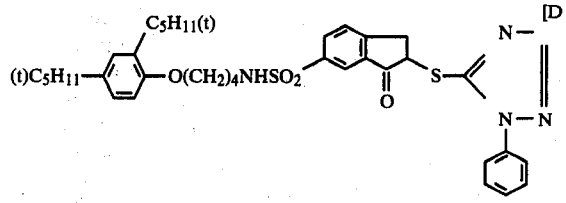

[D - 117]

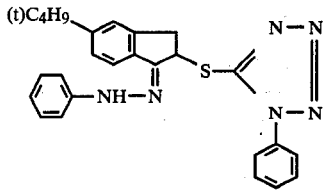

[D - 118]

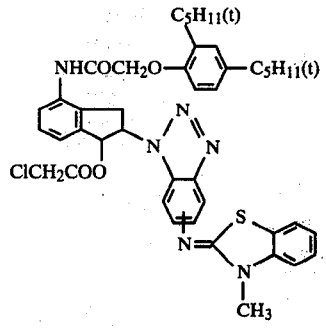

[D - 119]

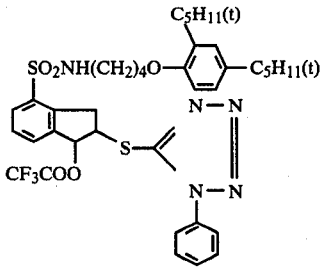

[D - 120]

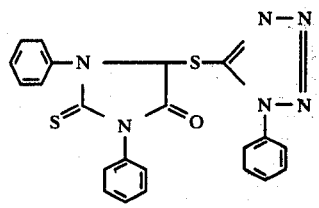

[D - 121]

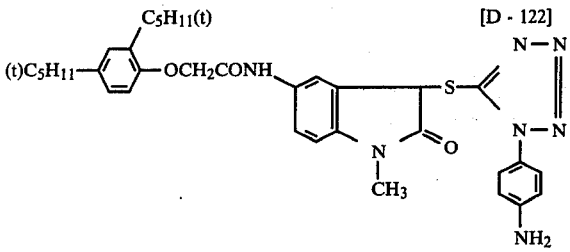

[D - 122]

It is preferable that the DIR compounds used in the present invention react at a higher speed with an oxidized product of a color developing agent. When compared in the same emulsion, the DIR compounds exhibiting the same desired gamma characteristic with a smaller amount than D-105 described above can give a high sharpness improvement effect and therefore is particularly preferable for the purpose of the present invention.

The amount of the DIR compound used in the light-sensitive color photographic material in accordance with the present invention may alter depending on the desired gamma characteristic, the reaction rate of the coupler with the color developing agent, halogen composition of the emulsion, crystal size or the like. Preferably, the proportion of the DIR compound is in the range between 0.001 and 0.02 moles per mole of the silver halide in the layer containing the DIR compound.

In the present invention, any color developing agent which is used for the development of a silver halide light-sensitive color photographic material may be used. For example, aromatic primary amines such as p-phenylenediamine and p-aminophenol described in the aforesaid literature 1 can be used.

The DIR compound can be incorporated in the light-sensitive material in various ways in accordance with the present invention. When the DIR compound is soluble in an alkali, it may be added in the form of an alkaline solution. When it is soluble in an oil, it is preferably dissolved in a high boiling solvent optionally in combination with a low boiling solvent and dispersed in the silver halide emulsion according to the procedures described in U.S. Pat. Nos. 2,322,027, 2,801,170, 2,801,171, 2,272,191 and 2,304,940. In this case, it is also possible to additionally add a coupler, a hydroquinone derivative, an ultra violet absorber, a discoloration preventing agent or the like as required. It is also possible to use a mixture of two or more DIR compounds. In the incorporation of the DIR compounds into the light-sensitive material, one or more DIR compounds may be dissolved optionally together with a coupler, a hydroquinone derivative, a discoloration preventing agent, an ultra violet ray absorber or the like as required in a high boiling solvent such as an organic acid amide, a carbamate, an ester, a ketone, a urea derivative or the like, particularly di-n-butyl phthalate, tri-cresyl phosphate, triphenyl phosphate, di-isooctyl azelate, di-n-butyl sebacate, tri-n-hexyl phosphate, N,N-di-ethyl-caprylamide butyl, N,N-diethyllaurylamide, n-pentadecyl phenyl ether, di-octyl phthalate, n-nonyl phenol, 3-pentadecyl phenyl ethyl ether, 2,5-di-sec.-amyl phenyl butyl ether, monophenyl-di-o-chlorophenyl phosphate, or a fluoroparaffin, if necessary, together with a low boiling solvent such as methyl acetate, ethyl acetate, propyl acetate, butyl acetate, butyl propionate, cyclohexanol, diethylene glycol monoacetate, nitromethane, carbon tetrachloride, chloroform, cyclohexane, tetrahydrofuran, methyl alcohol, acetonitrile, dimethyl formamide, dioxane or methyl ethyl ketone. (These high- and low-boiling solvents may be used alone or in admixture thereof). The solution thus formed may be mixed with an aqueous solution containing a hydrophilic binder such as gelatin and an anionic surface active agent such as alkylbenzenesulfonate or alkylnaphthalenesulfonate and/or a nonionic surface active agent such as sorbitan sesquioleate or sorbitan monolaurate. The mixture thus obtained may then be emulsified and dispersed in a high-speed rotating mixer, colloid mail, supersonic dispersing unit or the like, and added to the silver halide emulsion.

Further, DIR compound may be dispersed in the photosensitive material by a latex dispersing method. The latex dispersing method and its effect are described for example in Japanese Provisional Patent Publication Nos. 74538/1974, 59943/1976 and 32552/1979 and "Research Disclosure", August 1976, No. 14850, pages 77–79.

Examples of suitable latexes are homopolymers copolymers and terpolymers of monomers such as styrene, ethyl acrylate, n-butyl acrylate, n-butyl methacrylate, 2-acetoxacetoxyethyl methacrylate, 2-(methacryloyloxy)ethyltrimethylammonium sulfate, sodium 3-(methacryloyloxy)propane-1-sulfonate, N-isopropylacrylamide, N-[2-(2-methyl-4-oxopentyl)]acrylamide, and 2-acrylamide-2-methylpropane sulfonate. As the oil-in-water type emulsifying and dispersing method, any conventional method of dispersing hydrophobic additives such as couplers may be used. In such a latex dispersing method, the DIR compound used in the present invention may be dispersed at the same time as the coupler or may be separately dispersed and added independently.

Further, it is possible to control the layer affected by the development inhibitor or the unit layer by forming one or more scavenger layers at appropriate positions among the component layers of the photosensitive material.

As for the coupler used in the light-sensitive color photographic material in accordance with the present invention, i.e. the compound forming a dye by the reaction with an oxidate of the color developing agent, it is necessary only that it exists substantially at the time of color development. The coupler may be contained in the color developing solution or preferably in the light-sensitive color photographic material.

Generally, the coupler is contained in the light-sensitive layer of the light-sensitive color photographic material.

If the coupler is soluble in alkali, it may be added in the form of an alkaline solution. If it is soluble in oil, it may be added in the same way as the DIR compound as described above. The coupler may either be four equivalent or two equivalent type with respect to the silver ion.

Further, the coupler may be a low molecular coupler or the so-called polymeric coupler. The coupler may be any of the known photographic couplers, preferably α-benzoylacetanilide yellow coupler, α-pivaloylacetanilide yellow coupler, 5-pyrazolone magenta coupler, pyrazolinobenzoimidazole magenta coupler, phenol cyan coupler or naphthol cyan coupler.

Typical examples of the yellow couplers, cyan couplers and magneta couplers are set forth below.

Typical example of the alpha-acylacetamide yellow color forming couplers used in the present invention are:

[Y - 1]

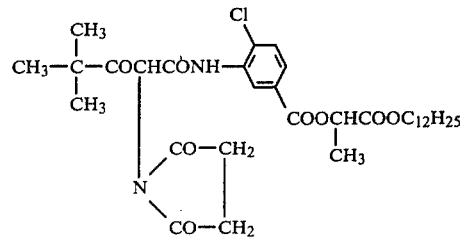

[Y - 2]

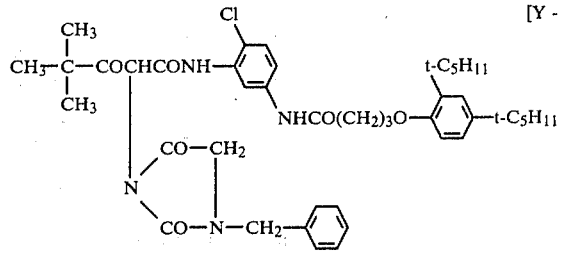

[Y - 3]

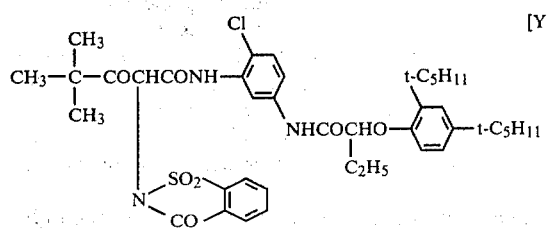

-continued
[Y - 4]
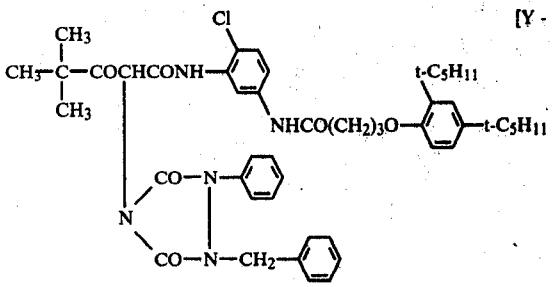
[Y - 5]
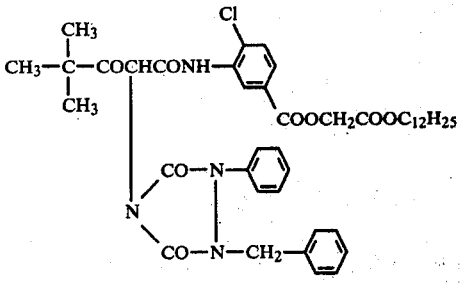
[Y - 6]
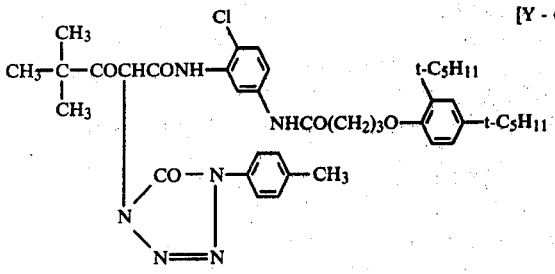
[Y - 7]
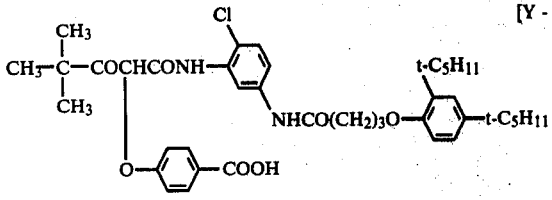
[Y - 8]
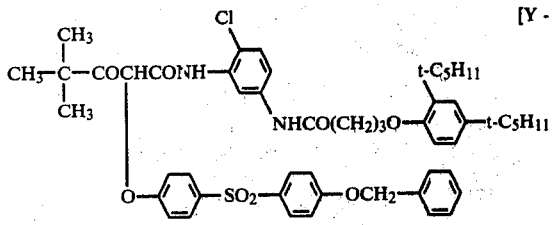
[Y - 9]
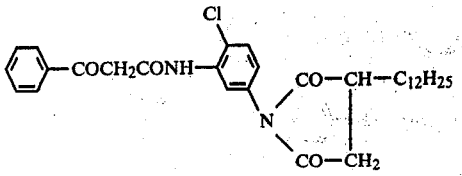
-continued
[Y - 10]
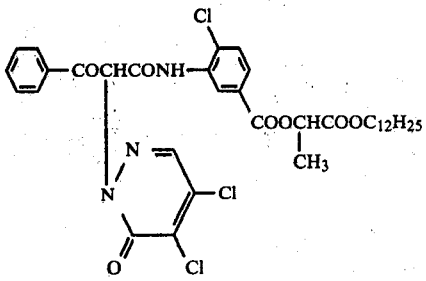
[Y - 11]
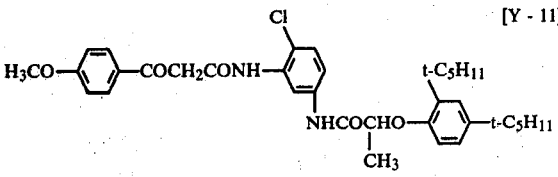
[Y - 12]
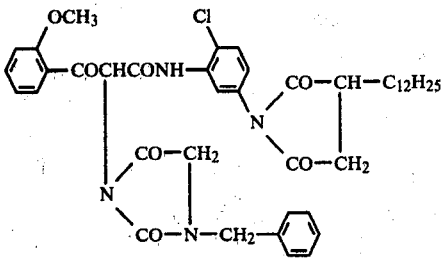
[Y - 13]
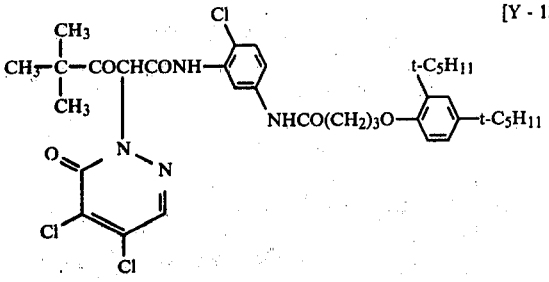
[Y - 14]
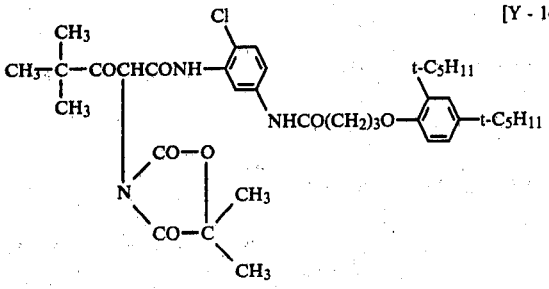
[Y - 15]
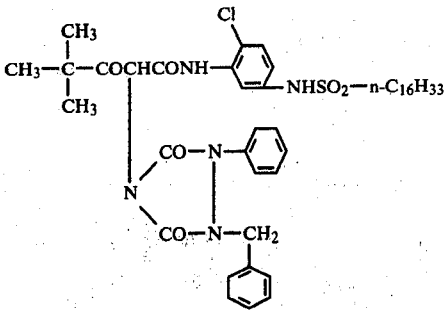

-continued

[Y - 16]

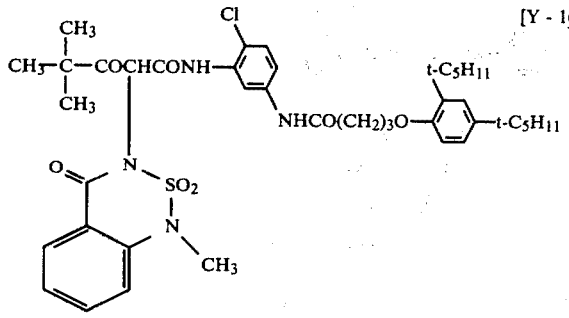

[Y - 17]

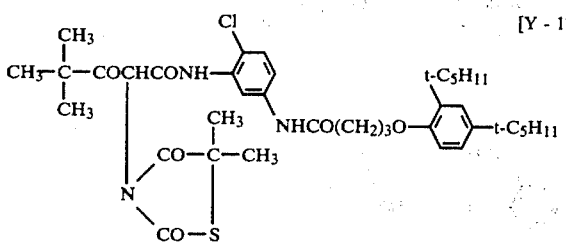

[Y - 18]

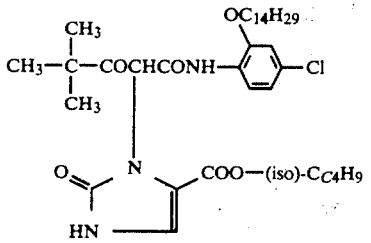

[Y - 19]

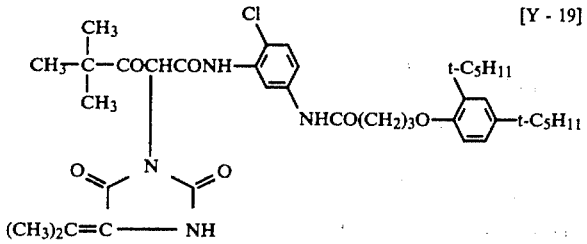

[Y - 20]

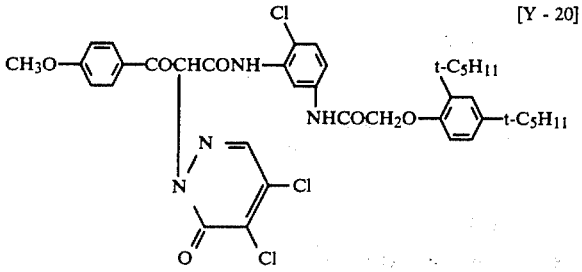

[Y - 21]

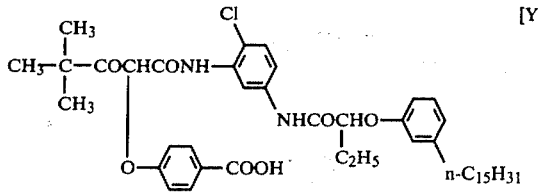

-continued

[Y - 22]

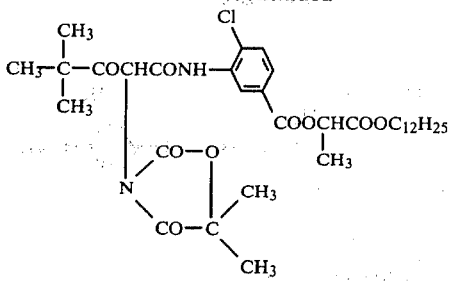

[Y - 23]

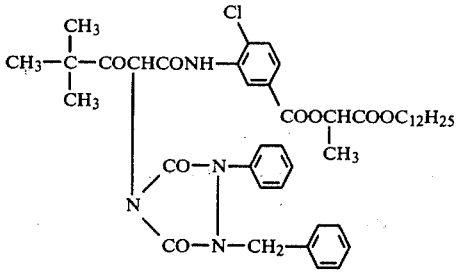

The alpha-acylacetamide yellow color forming couplers can be prepared by the methods described for example in West German Offenlegungsschrift Nos. 20 57 941 and 21 63 812, Japanese Provisional Patent Publication Nos. 26133/1972, 29432/1973, 66834/1973, 66835/1973, 94432/1973, 1229/1974, 10736/1974, 34232/1975, 65231/1975, 117423/1975, 3631/1976 and 50734/1976 and U.S. Pat. Nos. 3,227,550, 2,875,057 and 3,265,506.

The alpha-acylacetamide yellow color forming couplers may be contained in the silver halide emulsion layer individually or as a mixture of two or more couplers. They may be incorporated by conventional procedure in an amount between 1 and 30, preferably 5 and 30 mole % of blue-sensitive silver halide.

Typical examples of the cyan couplers are:

[C - 1]

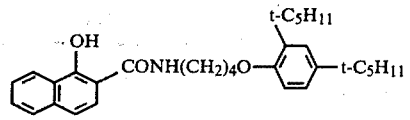

[C - 2]

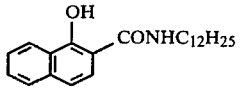

[C - 3]

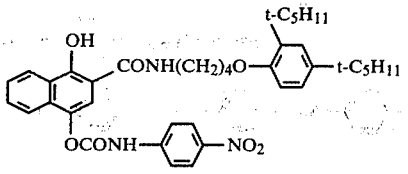

[C - 4]

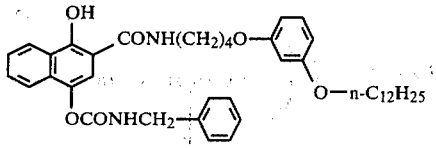

-continued
[C - 5]
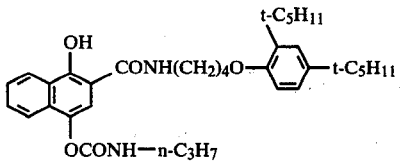
[C - 6]
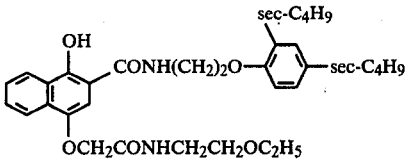
[C - 7]
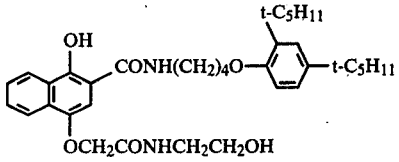
[C - 8]
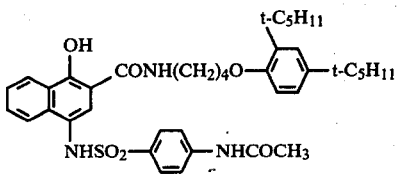
[C - 9]
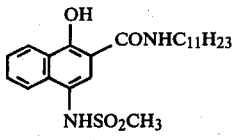
[C - 10]
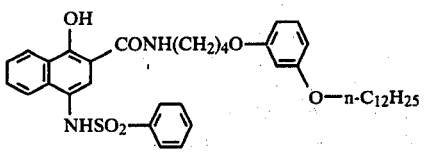
[C - 11]
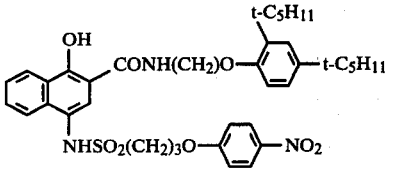
[C - 12]
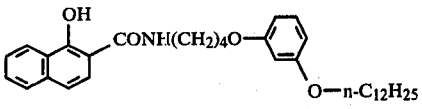
[C - 13]
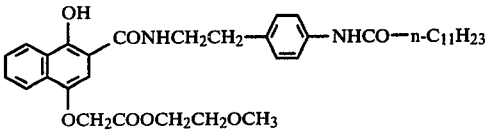
[C - 14]
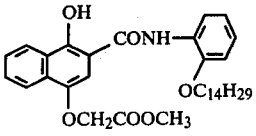
-continued
[C - 15]
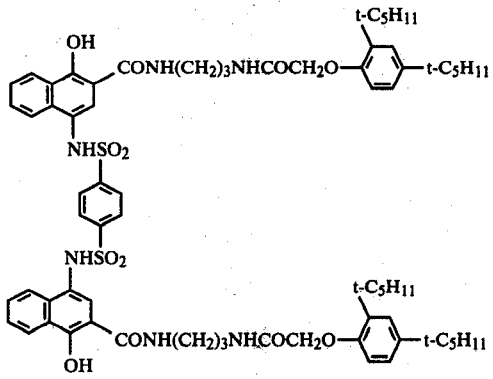
[C - 16]
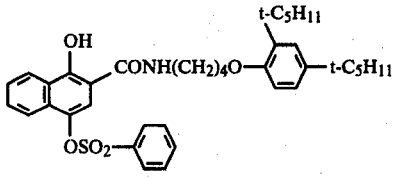
[C - 17]
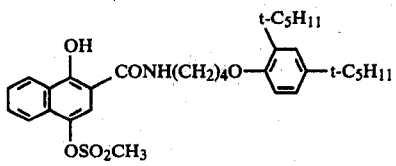
[C - 18]
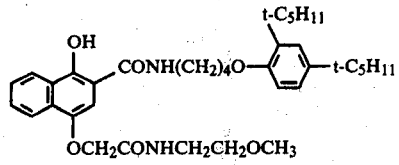
[C - 19]
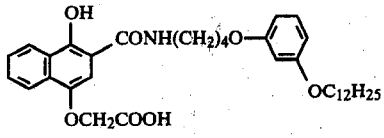
[C - 20]
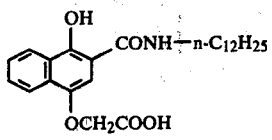
[C - 21]
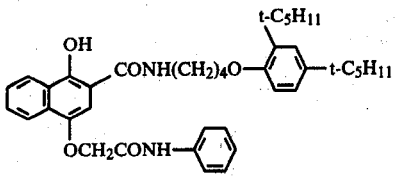
[C - 22]
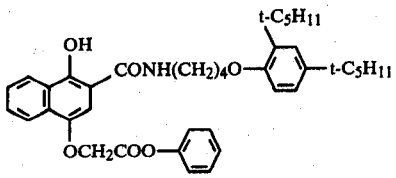
[C - 23]
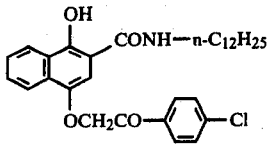

-continued

[C - 24]

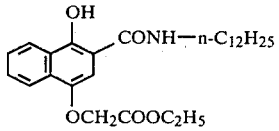

[C - 25]

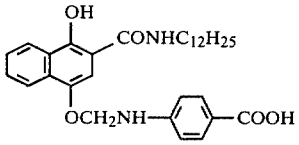

[C - 26]

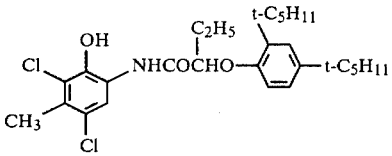

[C - 27]

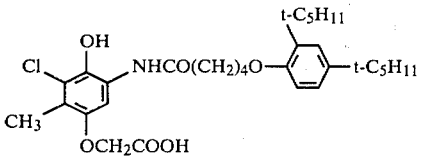

[C - 28]

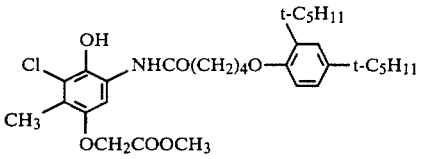

[C - 29]

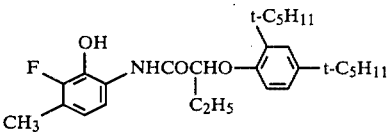

[C - 30]

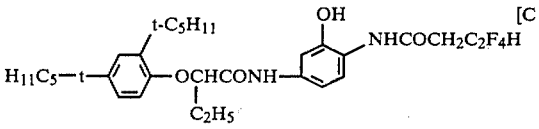

-continued

[C - 31]

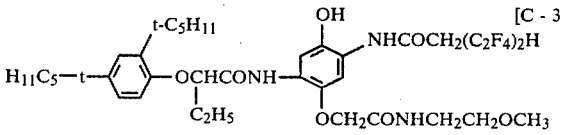

[C - 32]

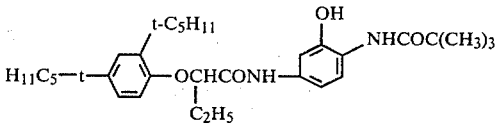

[C - 33]

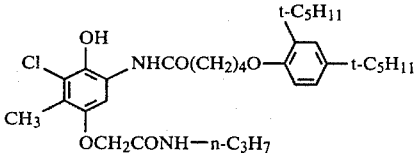

[C - 34]

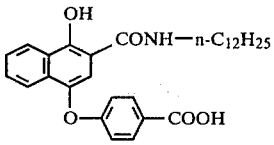

[C - 35]

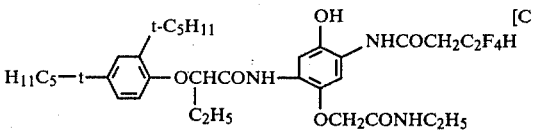

The cyan forming couplers can be prepared by the methods described for example in British Pat. No. 1,084,480, Japanese Provisional Patent Publication Nos. 117422/1975, 10135/1975, 37647/1976, 25228/1975 and 130441/1975. They are contained alone or in combination in the silver halide emulsion layer or contained in admixture with a so-called active-point arylazo-substituted colored coupler as described in U.S. Pat. No. 3,034,892, etc. They are incorporated by conventional procedures in an amount between 1 and 30, preferably 5 and 30 mole % of red-sensitive silver halide.

Examples of the magenta couplers used in the present invention are:

[M - 1]

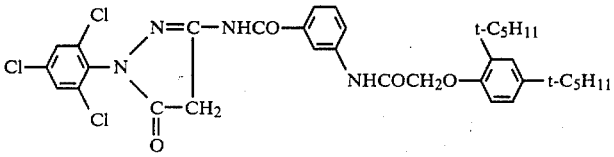

[M - 2]

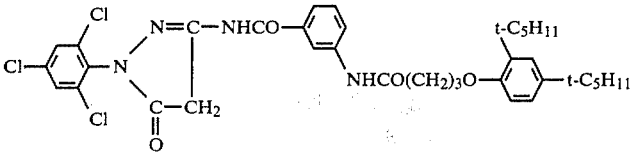

[M - 3]

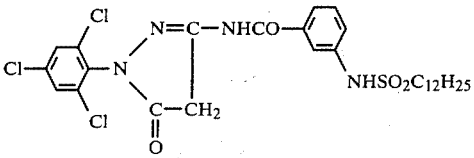

[M

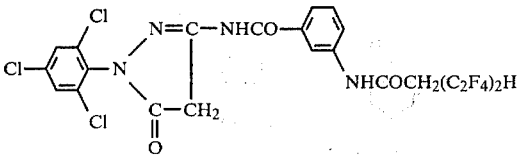

-continued
[M - 5]
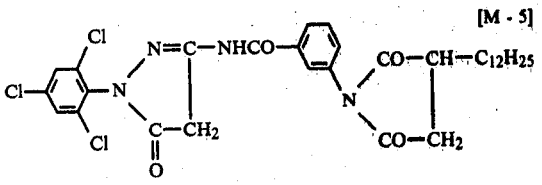
[M - 6]
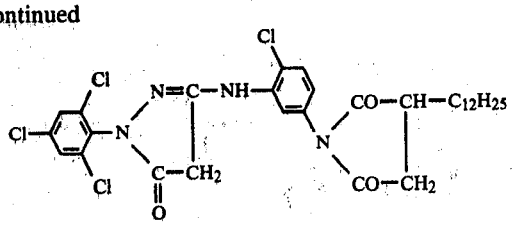
[M - 7]
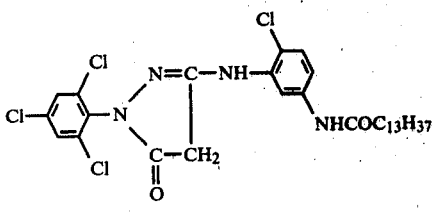
[M - 8]
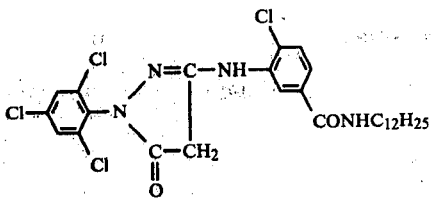
[M - 9]
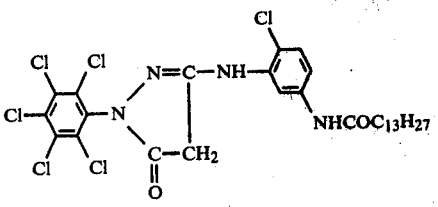
[M - 10]
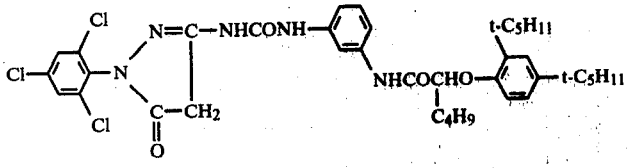
[M - 11]
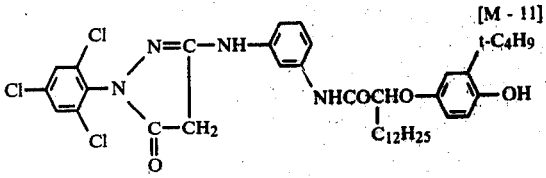
[M - 12]
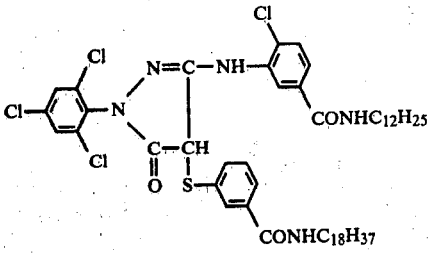
[M - 13]
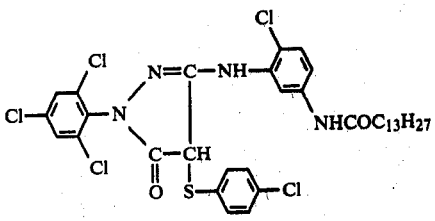
[M - 14]
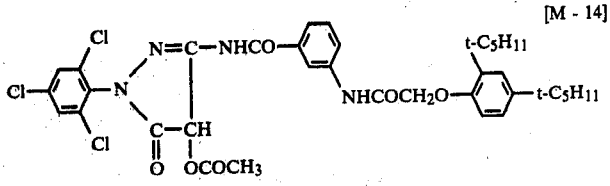
[M - 15]
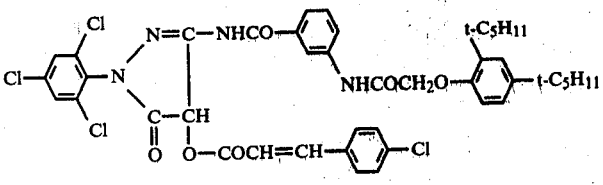
[M - 16]
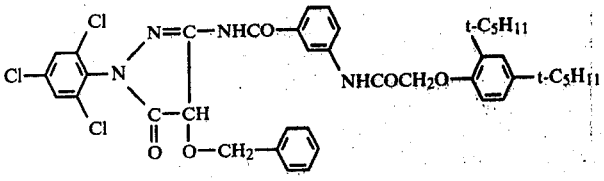

-continued
[M - 17]
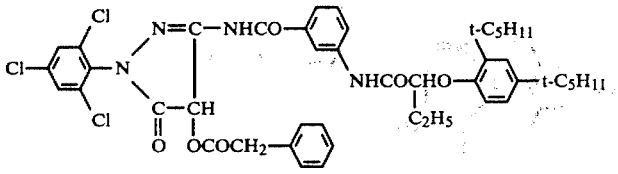
[M - 18]
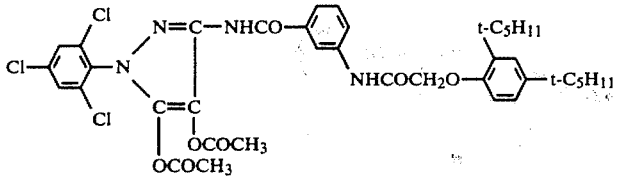
[M - 19]
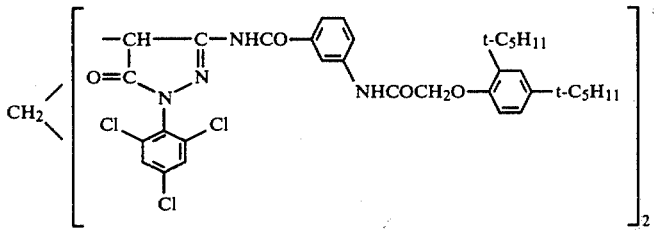
[M - 20]
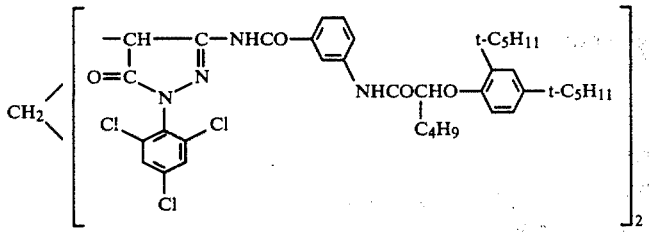
[M - 21]
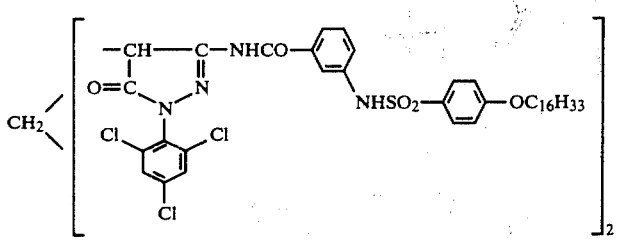
[M - 22]
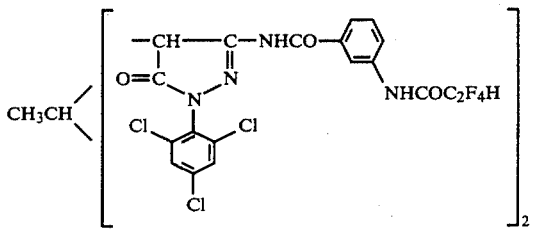
[M - 23]
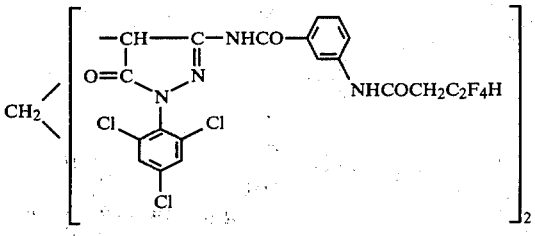
[M - 24]
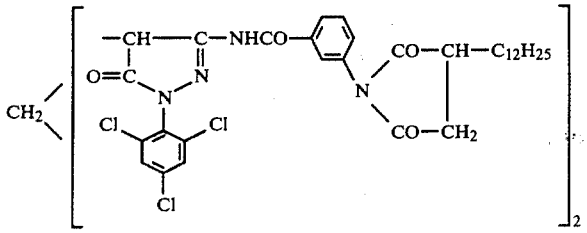

-continued
[M - 25]
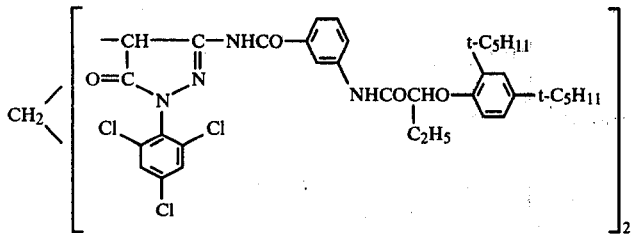
[M - 26]
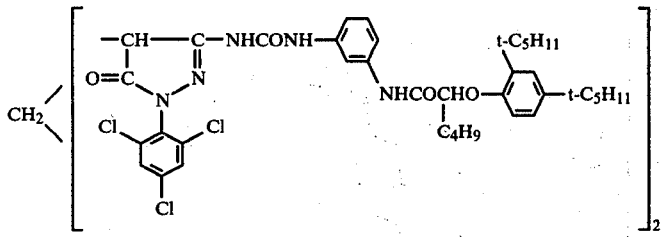
[M - 27]
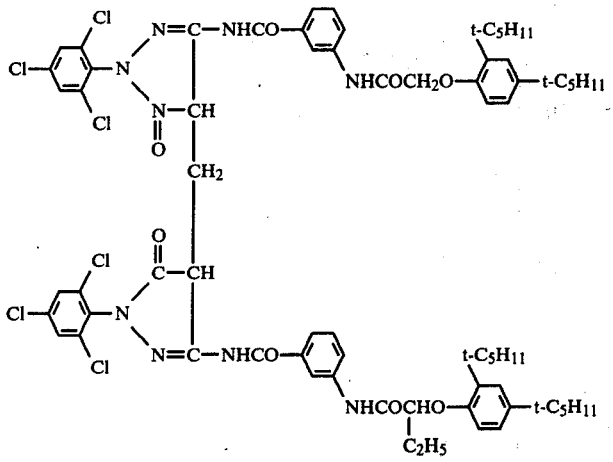
[M - 28]
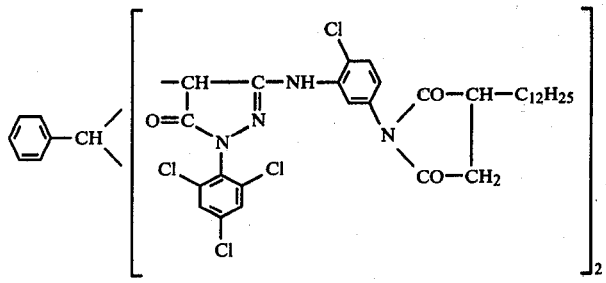
[M - 29]
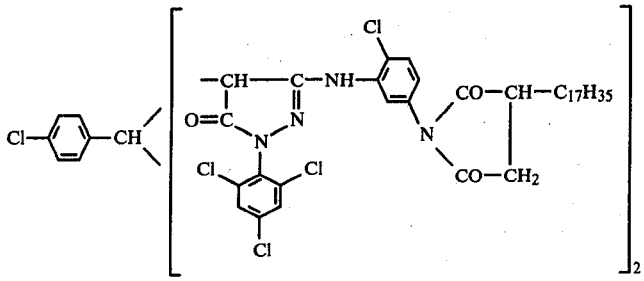

-continued
[M - 30]
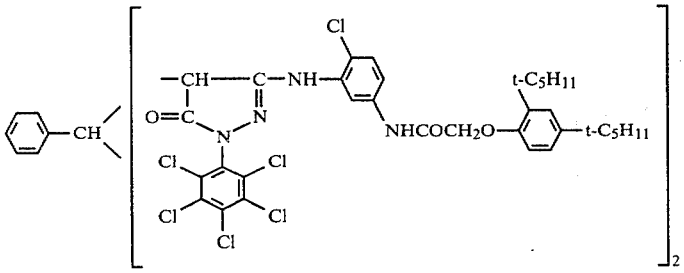
[M - 31]
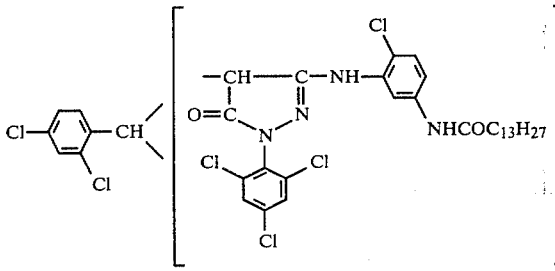
[M - 32]
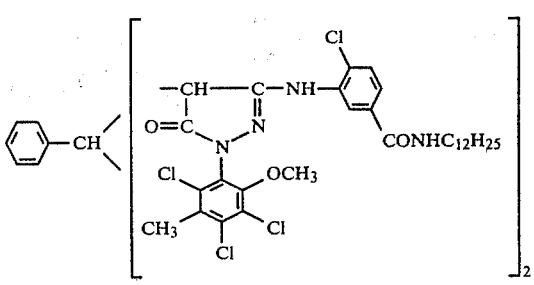
[M - 33]
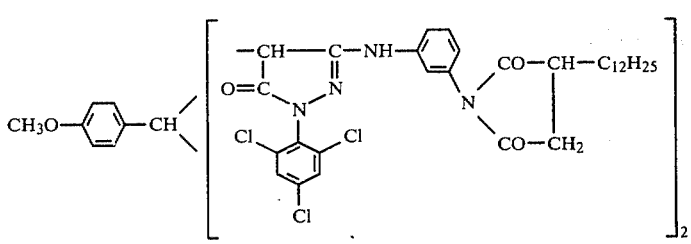
[M - 34]
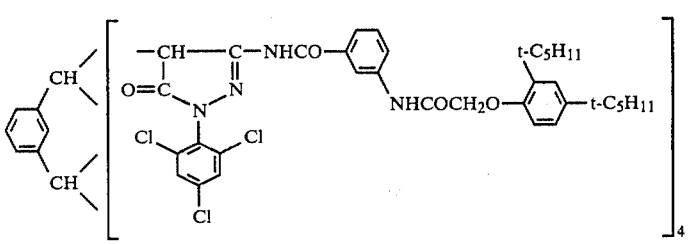
[M - 35]
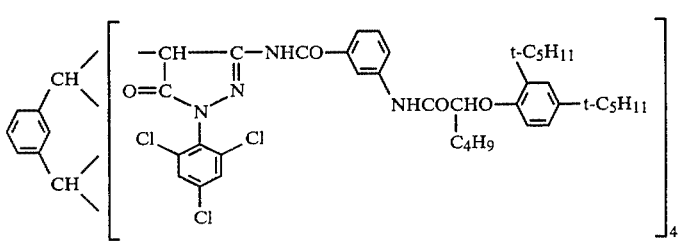
[M - 36]
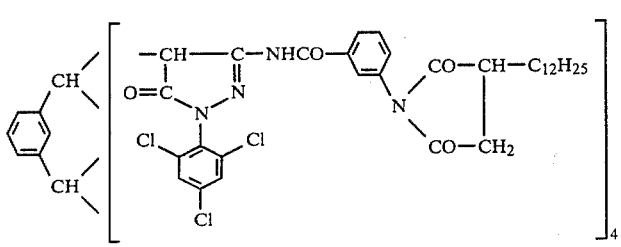

-continued

[M - 37]

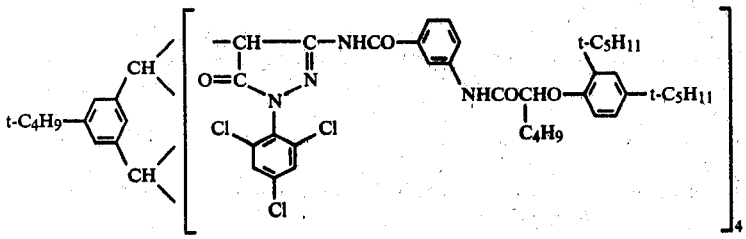

[M - 38]

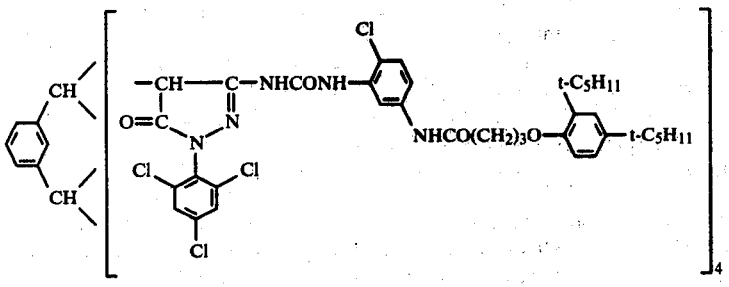

[M - 39]

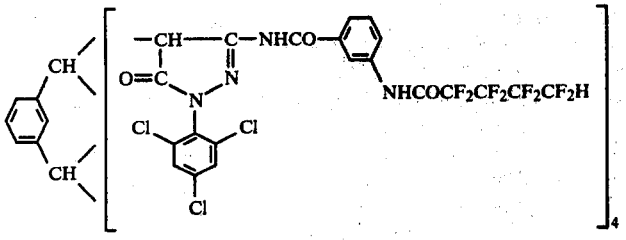

[M - 40]

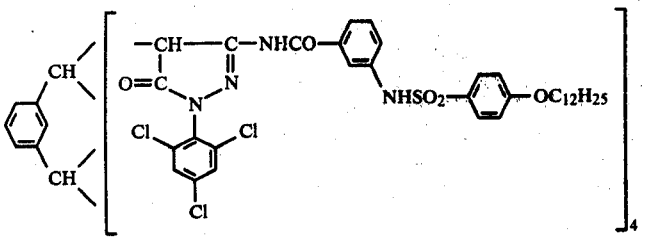

[M - 41]

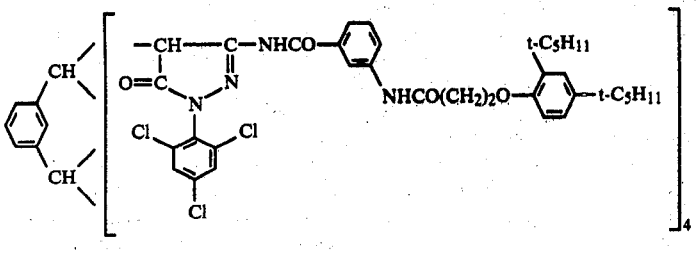

[M - 42]

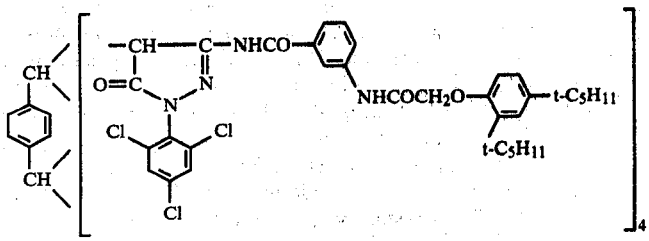

The magenta couplers used in the present invention also includes those described for example in U.S. Pat. Nos. 3,311,476, 3,419,391, 3,888,680 and 2,618,641, West German Offenlegungsschrift Nos. 20 15 814, 23 57 102 and 23 57 122 and Japanese Provisional Patent Publication Nos. 129538/1974, 105820/1976, 12555/1979, 48540/1979, 112342/1976, 112343/1976, 108842/1976 and 58533/1977. The methods of preparing them are also described in these literatures.

The magenta forming couplers are contained alone or in combination in the silver halide emulsion layer or contained in admixture with a so-called active-point arylazo-substituted colored coupler as described in U.S. Pat. No. 3,005,712, etc. They are incorporated by conventional procedures in an amount between 1 and 25 moles per mole of green-sensitive silver halide.

The light-sensitive color photographic material in accordance with the present invention may also contain a color contamination preventing agent, a light discoloration preventing agent, an ultra violet absorber and the like.

The color contamination preventing agents are used to prevent fog or contamination from occurring due to unnecessary reactions between the couplers and an oxidate of the developing agent formed by oxidation with air or the like. The color contamination preventing agents are described for example in U.S. Pat. Nos. 2,336,327, 2,360,290, 2,403,721, 2,701,197, 2,728,659 and 3,700,453, British Pat. No. 891,158 and Japanese Provisional Patent Publication No. 95948/1980.

The light discoloration preventing agents for the color forming dyes used in the present invention may be those described for example in U.S. Pat. Nos. 3,432,300, and 3,573,050 and Japanese Provisional Patent Publication Nos. 20977/1974, 31256/1973, 31625/1973, 17729/1978 and 48538/1979.

The ultra violet absorbers used in the present invention may for example be benzotriazole and benzophenone compounds described in U.S. Pat. Nos. 3,004,896, 3,253,921 and 3,705,805, Japanese Patent Publication No. 41572/1973 and Japanese Provisional Patent Publication No. 25337/1975.

The silver halide crystals used in the silver halide light-sensitive photographic material in accordance with the present invention may be prepared by the acid process, neutral process or ammonia process. It is also possible to prepare seed crystals by the acid process, and grow them up to the predetermined size by the ammonia process which gives a high growth rate. When growing the silver halide crystals, it is desirable that the pH, pAg or the like in the reactor are controlled, and silver ions and halide ions are both poured sequentially and simultaneously and mixed in guantities matching the growth rate of silver halide crystals, as described in, for example, Japanese Provisional Patent Publication No. 48521/1979 (so-called double jet method).

The silver halides may be chemically sensitized with active gelatin; a sulfur sensitizer e.g. allylthiocarbamide, thiourea or cystine; a selenium sensitizer; a reduction sensitizer e.g. tin (II) salt, thiourea dioxide and polyamine; a noble metal sensitizer, e.g. water-soluble gold salts such as potassium aurithiocyanate, potassium chloroaurate, or a water-soluble salt of platinum ruthenium, rhodium or iridium, e.g., potassium chloroplatinate (some of these serve as sensitizers or fog restrainers depending on the amount used). These sensitizers may be used alone or in combination (e.g. a combination of the gold sensitizer and the sulfur sensitizer, or with selenium sensitizer).

Further, the silver halides may be optically sensitized to a desired wavelength region for example by using an optical sensitizer e.g. a cyanine dye such as zeromethine dye, monomethine dye, dimethine dye or trimethine dye, or a merocyanine dye singly or in combination of two or more (e.g. supersensitized combination).

The other compositions of the silver halide light-sensitive photographic material in accordance with the present invention may be determined as described in the above-mentioned literature 1 or "Research Disclosure" No. 18431.

The present invention will hereinafter be described in further detail by the following nonlimitative examples.

The effect of improvement in the image sharpness was evaluated by determining the modulation transfer function (MTF) and comparing the MTF values at spatial frequencies of 10 lines/mm and 30 lines/mm.

The graininess (RMS) was evaluated by obtaining the standard deviation of the fluctuation in the density values occurring when a color image having a color image density of 1.0 is scanned with a microdensitometer having a circular scanning aperture of diameter of 25$\mu$, and comparing the value obtained by magnifying the standard deviation by a factor of 1000.

First, the preparations of the emulsions used in the examples are described below.

(Preparation of polydispersed emulsion)

An ammoniacal silver nitrate solution and an aqueous alkali halide solution were naturally dropped into a reactor containing an aqueous gelatin solution and an excess of halide and maintained at 60° C. Then, after an aqueous solution of Demole (manufacture by Kao Atlas Co., Ltd.) and an aqueous solution of magnesium sulfate were added to the reaction mixture to cause precipitation, desalting was conducted and gelatin was added to obtain an emulsion having a pAg value of 7.8 and a pH value of 6.0. Further, sodium thiosulfate, chloroauric acid and ammonium thiocyanate were added, and the resulting mixture was subjected to chemical ripening at 52° C. for 70 minutes. Thereafter, 4-hydroxy-6-methyl-1,3,3a,7-tetrazaindene and 6-nitrobenzoimidazole were added, and gelatin was added to obtain a polydispersed silver iodobromide emulsion. The molar percentage of the silver iodide was changed by changing the composition of the alkali halide, and the average crystal size and crystal size distribution were changed by changing the time for adding the ammoniacal silver nitrate solution and the aqueous alkali halide solution.

(Preparation of monodispersed emulsion)

An aqueous ammoniacal silver nitrate solution and an aqueous potassium bromide solution were added to a reactor containing potassium iodide and an aqueous gelatin solution while the pAg value in the reactor was maintained constant. This addition was done in proportion to the increase in the surface area of crystals during the growth thereof. Then, after an aqueous solution of Demole (manufactured by Kao Atlas Co., Ltd.) and an aqueous solution of magnesium sulfate were added to cause precipitation, desalting was conducted and gelatin was added to obtain an emulsion having a pAg value of 7.8 and a pH value of 6.0. Further, sodium thiosulfate, chloroauric acid and ammonium thiocyanate were added, and the resulting mixture was subjected to chemical ripening. Thereafter, 4-hydroxy-6-methyl-1,3,3a,7-tetrazaindene and 6-nitrobenzoimidazole were added, and gelatin was further added to obtain a monodispersed silver iodobromide emulsion. The shapes of silver halide crystals were controlled by changing the pAg value, and the molar percentage of the silver iodide was changed by changing the ratio of potassium iodide to potassium bromide. The crystal size was changed by changing the amounts of the ammoniacal silver nitrate and the potassium halide added. The proportional relationship between the rate of adding the aqueous ammoniacal silver nitrate solution and the aqueous potassium bromide solution and the rate of increase in the surface area of crystals during the growth thereof was changed, and in this way, the silver bromoiodide emulsion used in Example 1, in which the crystal size distribution was wider than the monodispersed emulsion in accordance with the present invention and narrower than the polydispersed emulsion described above, was also prepared.

EXAMPLE 1

A DIR compound listed in Table 1 and 15 g of 1-(2,4,6-trichlorophenyl)-3-[3-(2,4-di-tert-amylphenoxyacetamideo)benzoamidio]-5-pyrazolone as a magenta coupler were dissolved in 30 ml of ethyl acetate and 15 ml of dibutyl phthalate. The solution thus obtained was mixed with 20 ml of a 10% aqueous solution of Alkanol B (alkylnaphthalenesulfonate available from du Pont) and 200 ml of a 5% aqueous gelatin solution. The mixture was then emulsified and dispersed in a colloid mill. The dispersion thus obtained was then added to 1 kg of green-sensitive silver iodobromide emulsion (containing 5.0 mole % of silver iodide) listed in Table 1. The composition thus obtained was applied to a triacetate base having an antihalation layer so that the silver amount is 20 mg/dm$^2$, and dried to yield Specimen Nos. 1 to 9.

TABLE 1

| Specimen No. | Silver Iodobromide Crystals | | DIR Compound Used: DIR Compound | DIR Compound Used: Amount [mole/mole Ag × 100] |
|---|---|---|---|---|
| 1 (Comparison) | $\bar{r}$ | 1.03μ | D-103 | 0.23 |
| | S | 0.361μ | | |
| | S/$\bar{r}$ | 0.35 | | |
| | Crystal habit | Twinned Crystals | | |
| 2 (Comparison) | $\bar{r}$ | 1.05μ | D-103 | 0.25 |
| | S | 0.19μ | | |
| | S/$\bar{r}$ | 0.20 | | |
| | Crystal habit | Twinned and Cubic Crystals | | |
| 3 (Comparison) | $\bar{r}$ | 0.92μ | D-103 | 0.25 |
| | S | 0.18μ | | |
| | S/$\bar{r}$ | 0.18 | | |
| | Crystal habit | Twinned and Octahedrons | | |
| 4 | $\bar{r}$ | 0.91μ | D-103 | 0.30 |
| | S | 0.11μ | | |
| | S/$\bar{r}$ | 0.12 | | |
| | Crystal habit | Cubics | | |
| 5 | $\bar{r}$ | 1.04μ | D-103 | 0.30 |
| | S | 0.083μ | | |
| | S/$\bar{r}$ | 0.08 | | |
| | Crystal habit | Cubics | | |
| 6 | $\bar{r}$ | 0.91μ | D-103 | 0.33 |
| | S | 0.11μ | | |
| | S/$\bar{r}$ | 0.12 | | |
| | Crystal habit | Tetradecahedrons | | |
| 7 | $\bar{r}$ | 1.03μ | D-105 | 0.33 |
| | S | 0.093μ | | |
| | S/$\bar{r}$ | 0.09 | | |
| | Crystal habit | Tetradecahedrons | | |
| 8 | $\bar{r}$ | 0.91μ | D-105 | 0.32 |
| | S | 0.11μ | | |
| | S/$\bar{r}$ | 0.12 | | |
| | Crystal habit | Octahedrons | | |
| 9 | $\bar{r}$ | 1.05μ | D-105 | 0.32 |
| | S | 0.095μ | | |
| | S/$\bar{r}$ | 0.09 | | |
| | Crystal habit | Octahedrons | | |

Each of the above-described nine specimens was individually brought into close contact with a transparent square chart or wedge, exposed to green light, and processed as described below to obtain a specimen having a color image.

| Processes (processing temperature: 38° C.) | Processing time |
|---|---|
| Color development | 3 minutes 15 seconds |
| Bleaching | 6 minutes 30 seconds |
| Washing with water | 3 minutes 15 seconds |
| Fixing | 6 minutes 30 seconds |
| Washing with water | 3 minutes 15 seconds |
| Stabilization | 1 minutes 30 seconds |
| Drying | |

The following processing solutions were used in the above-mentioned processing steps:

| | |
|---|---|
| (Color developing solution) | |
| 4-Amino-3-methyl-N—ethyl-N—(β-hydroxyethyl)-aniline sulfate | 4.75 g |
| Anhydrous sodium sulfite | 4.25 g |
| Hydroxylamine half-sulfate | 2.0 g |
| Anhydrous potassium carbonate | 37.5 g |
| Sodium bromide | 1.3 g |
| Trisodium nitrilo triacetate (monohydrate) | 2.5 g |
| Potassium hydroxide | 1.0 g |
| Made up to 1 liter with water | |
| (Bleaching solution) | |
| Ferric ammonium salt of ethylenediaminetetraacetic acid | 100.0 g |
| Diammonium salt of ethylenediaminetetraacetic acid | 10.0 g |
| Ammonium bromide | 150.0 g |
| Glacial acetic acid | 10.0 ml |
| Made up to 1 liter with water and adjusted to pH 6.0 with aqueous ammonia. | |
| (Fixing solution) | |

-continued

| | |
|---|---|
| Ammonium thiosulfate | 175.0 g |
| Anhydrous sodium sulfite | 8.6 g |
| Sodium metasulfite | 2.3 g |
| Made up to 1 liter with water and adjusted to pH 6.0 with acetic acid. | |
| (Stabilizing solution) | |
| Formalin (37% aqueous solution) | 1.5 ml |
| Konidax (available from Konishiroku Photo Industry Co., Ltd.) | 7.5 ml |
| Made up to 1 liter with water. | |

The photographic characteristics, sharpness and graininess were measured with respect to the obtained color image. The results were as shown in Table 2. The sensitivity was indicated in terms of the relative sensitivity with the sensitivity of Specimen No. 1 taken as 100.

TABLE 2

| Specimen No. | Sensitivity | Gamma (γ) | Sharpness in terms of MTF (%) 10 lines/mm | 30 lines/mm |
|---|---|---|---|---|
| 1 (Comparison) | 100 | 0.85 | 98 | 60 |
| 2 (Comparison) | 101 | 0.86 | 103 | 63 |
| 3 (Comparison) | 96 | 0.85 | 106 | 67 |
| 4 | 95 | 0.84 | 122 | 88 |
| 5 | 100 | 0.83 | 125 | 90 |
| 6 | 96 | 0.85 | 128 | 93 |
| 7 | 102 | 0.84 | 130 | 95 |
| 8 | 96 | 0.86 | 127 | 93 |
| 9 | 99 | 0.85 | 131 | 94 |

As shown in Table 2, Specimen Nos 4 to 9 containing the emulsions containing silver halide crystals having narrow crystal size distribution and the DIR compound in accordance with the present invention exhibited a considerably improved sharpness compared with the emulsions (Specimen Nos. 1 to 3) having wide crystal size distribution.

Further, the results in Table 2 show that the silver iodobromide having regular octahedral or tetradecahedral crystals are preferably used in the present invention and that the smaller $S/\bar{r}$ value is, greater the improvement in the image sharpness becomes.

EXAMPLE 2

Specimen Nos. 10 to 14 were prepared in the same way as Specimen Nos. 1, 2, 5, 7 and 9 in Example 1, except that D-111 was used in an amount of 0.0030 mole per mole of silver iodobromide instead of D-103. Each specimen was exposed in the same mannr as in Example 1 and developed with the same developing solution as in Example 1. However, to make the gamma value of each specimen constant, the color development time was changed and color development was interrupted when the gamma value was 0.8. Thereafter, bleaching and subsequent processings were conducted, and the photographic characteristics and sharpness of the obtained color image were determined. The results were as shown in Table 3.

TABLE 3

| Specimen No. | Development time (38° C.) | Relative sensitivity | MTF 10 lines/mm | 30 lines/mm | RMS |
|---|---|---|---|---|---|
| 10 | 3 min. 30 sec. | 100 | 104 | 64 | 92 |

TABLE 3-continued

| Specimen No. | Development time (38° C.) | Relative sensitivity | MTF 10 lines/mm | 30 lines/mm | RMS |
|---|---|---|---|---|---|
| 11 | 3 min. 15 sec. | 102 | 105 | 66 | 84 |
| 12 | 2 min. 40 sec. | 105 | 113 | 78 | 71 |
| 13 | 2 min. 30 sec. | 104 | 116 | 80 | 70 |
| 14 | 2 min. 15 sec. | 106 | 117 | 80 | 71 |

As shown in Table 3, when the amount of the DIR compound used was the same, Specimen Nos. 12, 13 and 14 containing the emulsions having narrow crystal size distribution in accordance with the present invention allowed a shorter development time and exhibited improved sharpness and graininess compared with Specimen Nos. 10 and 11 in which emulsions having wide crystal size distribution were employed.

EXAMPLE 3

In this Example, Specimen Nos. 15 to 23 were prepared in the same manner as in Example 1 except that a red-sensitive silver iodobromide emulsion by the use of sensitizing dyes instead of the green-sensitive emulsion, DIR compound D-6 instead of D-103 in an amount to give γ value of approximately 0.8 and 10.6 g of 1-hydroxy-N-[4-(2,4-di-tert-amylphenoxy)butyl]-2-naphthoamide as a cyan coupler dissolved in 30 ml of ethyl acetate and 15 ml of dibutyl phthalate instead of the magenta coupler were used.

Each of the above-described nine specimens were individually brought into close contact with a transparent square chart or wedge, exposed to red light, and processed in the same way as in Example 1 to obtain a specimen having a color image.

The photographic characteristics and sharpness were measured with respect to the obtained color image. The results were as shown in Table 4. The sensitivity was indicated in terms of the relative sensitivity with the sensitivity of Specimen No. 15 taken as 100.

TABLE 4

| Specimen No. | Sensitivity | Gamma (γ) | Sharpness in terms of MTF (%) 10 lines/mm | 30 lines/mm |
|---|---|---|---|---|
| 15 (Comparison) | 100 | 0.79 | 92 | 55 |
| 16 (Comparison) | 101 | 0.78 | 97 | 59 |
| 17 (Comparison) | 97 | 0.79 | 103 | 63 |
| 18 | 96 | 0.77 | 117 | 81 |
| 19 | 100 | 0.78 | 119 | 83 |
| 20 | 97 | 0.79 | 122 | 87 |
| 21 | 102 | 0.78 | 125 | 89 |
| 22 | 98 | 0.79 | 123 | 87 |
| 23 | 100 | 0.77 | 126 | 90 |

As clearly shown in Table 4, the present invention can improve the sharpness even when a cyan dye image is formed by use of a red-sensitive emulsion.

EXAMPLE 4

In this example, Specimen Nos. 24 to 32 were prepared in the same manner as in Example 1 except that a blue-sensitive silver iodobromide emulsion instead of the green-sensitive emulsion DIR compound D-4 instead of D-103 in an amount to give γ value of approximately 0.8 and as a yellow coupler α-pivaloyl-α-(1-benzyl-1-phenyl-1,2,4-triazole-3,5-dion-4-yl)-2-chloro-5-[γ-

(2,4-di-tert-amylphenoxy)butaneamido]acetanilide instead of the magenta coupler were used.

Each of the above-described two specimens was individually brought into close contact with a transparent square chart or wedge, exposed to blue light, and processed as described in Example 1 to obtain a specimen having a color image.

The photographic characteristics and sharpness were measured with respect to the obtained color image. The results were as shown in Table 5. The sensitivity was indicated in terms of the relative sensitivity with the sensitivity of Specimen No. 24 taken as 100.

TABLE 5

| Specimen No. | Sensitivity | Gamma (γ) | Sharpness in terms of MTF (%) 10 lines/mm | 30 lines/mm |
|---|---|---|---|---|
| 24 (Comparison) | 100 | 0.79 | 92 | 61 |
| 25 (Comparison) | 100 | 0.77 | 98 | 65 |
| 26 (Comparison) | 98 | 0.78 | 102 | 70 |
| 27 | 97 | 0.77 | 116 | 81 |
| 28 | 100 | 0.79 | 118 | 83 |
| 29 | 98 | 0.78 | 122 | 86 |
| 30 | 101 | 0.78 | 124 | 89 |
| 31 | 99 | 0.79 | 121 | 87 |
| 32 | 100 | 0.77 | 123 | 89 |

As clearly shown in Table 5, the specimen in accordance with the present invention exhibits a higher sharpness than that in the comparative specimen even when a yellow dye image is formed by use of a blue-sensitive layer.

Experiments were conducted in the same manner as in Examples 1, 3 and 4 except for the uses of D-1, D-4, D-5, D-6, D-10, D-11, D-19, D-22, D-26, D-32, D-38, D-42, D-48, D-53, D-58, D-60, D-100, D-102, D-103, D-107 and D-109 instead of DIR compounds as used in Examples 1, 3 and 4 to give similar results.

EXAMPLE 5

Specimen No. 33 was prepared by sequentially applying the layers described below on a transparent support of an under-coated cellulose triacetate film. (In all examples below, the addition amount to the silver halide light-sensitive color photographic material is the amount per 1 $m^2$, and the amounts of the silver halide emulsion and the colloidal silver are expressed in terms of silver).

(Specimen No. 33)

Layer 1: Antihalation layer containing 0.4 g of black colloidal silver and 3 g of gelatin.

Layer 2: Low-sensitivity red-sensitive emulsion layer containing 1.5 g of silver iodobromide low-sensitivity red-sensitive emulsion (AgI: 6 mole %), 1.6 g of gelatin and 0.4 g of tricresyl phosphate (hereinafter referred to as TCP) in which 0.80 g of 1-hydroxy-4-[β-methoxyethylaminocarbonylmethoxy]-N-[δ-(2,4-di-tert-amylphenoxy)butyl]-2-naphthoamide (hereinafter referred to as cyan coupler C-1), 0.028 g of 1-hydroxy-4-[4-(1-hydroxy-8-acetamido-3,6-disulfo-2-naphthylazo)phenoxy]-N-[δ-(2,4-di-tert-amylphenoxy)butyl]-2-naphthoamide disodium salt (hereinafter referred to as colored cyan coupler CC-1), and 0.22 g of the DIR compound D-102 were dissolved.

Layer 3: High-sensitivity red-sensitive emulsion layer containing 1.1 g of a silver iodobromide high-sensitivity red-sensitive emulsion (AgI: 7 mole %), 1.2 g of gelatin and 0.15 g of TCP in which 0.23 g of the cyan coupler C-1, 0.02 g of the colored cyan coupler CC-1 and 0.085 g of the DIR compound D-102 were dissolved.

Layer 4: Intermediate layer containing 1.2 g of gelatin and 0.04 g of di-n-butyl phthalate (hereinafter referred to as DBP) in which 0.07 g of 2,5-di-tert-octylhydroquinone (hereinafter referred to as stain preventing agent HQ-1) was dissolved.

Layer 5: Low-sensitivity green-sensitive emulsion layer containing 1.6 g of a silver iodobromide low-sensitivity green-sensitive emulsion (AgI: 5 mole %), 1.7 g of gelatin and 0.3 g of TCP in which 0.30 g of 1-(2,4,6-trichlorophenyl)-3-[3-(2,4-di-tert-amylphenoxyacetamido]-5-pyrazolone (hereinafter referred to as magenta coupler M-1), 0.20 g of 4,4-methylenebis-1-(2,4,6-trichlorophenyl)-3-[3-(2,4-di-tert-amylphenoxyacetamido)benzeneamido]-5-pyrazolone (hereinafter referred to as magenta coupler M-2), 0.066 g of 1-(2,4,6-trichlorophenyl)-4-(1-naphthylazo)-3-(2-chloro-5-octadecenylsuccinimidonanilino)-5-pyrazolone (hereinafter referred to as colored magenta coupler CM-1), and 0.26 g of the DIR compound D-102 were dissolved.

Layer 6: High-sensitivity green-sensitive emulsion layer containing 1.5 g of a silver iodobromide high-sensitivity green-sensitive emulsion (AgI: 7 mole %), 1.9 g of gelatin and 0.12 g of TCP in which 0.093 g of the magenta coupler M-1, 0.094 g of the magenta coupler M-2, 0.049 g of the colored magenta coupler CM-1, and 0.15 g of the DIR compound D-102 were dissolved.

Layer 7: Yellow filter layer containing 0.2 g of yellow colloidal silver, 0.11 g of DBP in which 0.2 g of stain preventing agent HQ-1 was dissolved, and 2.1 g of gelatin.

Layer 8: Low-sensitivity blue-sensitive emulsion layer containing 0.95 g of a silver iodobromide low-sensitivity blue-sensitive emulsion (AgI: 6 mole %), 1.9 g, of gelatin and 0.93 g of DBP in which 1.84 g of α-[4-(1-benzyl-2-phenyl-3,5-dioxo-1,2,4-triazolidinyl)]-α-pivaloyl-2-chloro-5-[γ-(2,4-di-tert-amylphenoxy)butylamido]acetanilide (hereinafter referred to as yellow coupler Y-1), and 0.15 g of the DIR compound D-102 were dissolved.

Layer 9: High-sensitivity blue-sensitive emulsion layer containing 1.2 g of a silver iodobromide high-sensitivity blue-sensitive emulsion (AgI: 7 mole %), 2.0 g of gelatin and 0.23 g of DBP in which 0.46 g of the yellow coupler Y-1 and 0.029 g of the DIR compound D-102 listed in Table 8 were dissolved.

Layer 10: Protective layer containing 2.3 g of gelatin.

Specimen 34 was prepared in the same way as Specimen No. 33, except that the silver iodobromide Emulsion No. the DIR compound and the addition amount were as shown in Table 6.

TABLE 6

| Specimen No. | | Layer | Silver iodobromide Emulsion No. (see Table 7) | DIR Compound | Addition amount of DIR compound [mole/mole Ag × 100] |
|---|---|---|---|---|---|
| 33 | Comparative | 2 | 1 | D-102 | 0.22 |
| | | 3 | 2 | " | 0.085 |
| | | 5 | 3 | " | 0.26 |
| | | 6 | 2 | " | 0.15 |
| | | 8 | 1 | " | 0.15 |
| | | 9 | 2 | " | 0.029 |
| 34 | According to the present invention | 2 | 4 | " | 0.28 |
| | | 3 | 5 | " | 0.11 |
| | | 5 | 6 | " | 0.33 |
| | | 6 | 5 | " | 0.19 |
| | | 8 | 4 | " | 0.28 |
| | | 9 | 5 | " | 0.055 |

TABLE 7

| | Emulsion No. | | | | | |
|---|---|---|---|---|---|---|
| | 1 | 2 | 3 | 4 | 5 | 6 |
| Mole % of silver iodide | 6 | 7 | 5 | 6 | 7 | 5 |
| Average crystal size ($\bar{r}$) | 0.85μ | 1.05μ | 0.80μ | 0.84μ | 1.03μ | 0.80μ |
| Standard deviation (S) | 0.17μ | 0.19μ | 0.15μ | 0.076μ | 0.082μ | 0.064μ |
| $S/\bar{r}$ | 0.20 | 0.18 | 0.19 | 0.09 | 0.08 | 0.08 |
| Crystal habit | Twinned and Octahedrons | Twinned and Octahedrons | Twinned and Octahedrons | Octahedrons | Octahedrons | Octahedrons |

The obtained specimens where individually brought into close contact with a transparent square wave chart or wedge, and exposed to blue, green and red monochromatic light, followed by the color development according to the procedure described in Example 1. The results of the photographic characteristics and sharpness were as shown in Table 8.

As for the sensitivity, the blue sensitivity, green sensitivity and red sensitivity of Specimen No. 33 were taken as 100, and the color sensitivities of Specimen No. 34 were expressed as the relative values.

TABLE 8

| Specimen No. | | Relative sensitivity | Gamma | MTF value (%) 10 lines/mm | MTF value (%) 30 lines/mm |
|---|---|---|---|---|---|
| 33 | Exposure to Blue Light | 100 | 0.87 | 89 | 56 |
| | Exposure to Green Light | 100 | 0.85 | 87 | 50 |
| | Exposure to Red Light | 100 | 0.84 | 79 | 32 |
| 34 | Exposure to Blue Light | 101 | 0.86 | 110 | 82 |
| | Exposure to Green Light | 99 | 0.86 | 110 | 74 |
| | Exposure to Red Light | 102 | 0.85 | 97 | 54 |

Table 8 shows that the multi-layer specimens gives the results similar to those obtained with the single layer specimens in Examples 1, 3 and 4, and exhibit greatly improved sharpness without generating defects.

We claim:

1. A silver halide light-sensitive color photographic material which comprises a support and coated thereon a light-sensitive layer containing a compound which, upon reaction with an oxidized color developing agent, is capable of releasing a diffusible development inhibitor and a negative type light-sensitive silver halide emulsion containing light-sensitive silver halide crystals consisting essentially of monodispersed silver halide crystals having a size distribution satisfying the following relationship:

$S/\bar{r} \leqq 0.15$; wherein $S = \sqrt{\Sigma(\bar{r} - r_i)^2 n_i^2 / \Sigma n_i}$ and $\bar{r} = \Sigma n_i r_i / \Sigma n_i$;

and wherein S represents the standard deviation, $\bar{r}$ represents the average crystal size, $r_i$ represents the crystal size of individual silver halide crystals and $n_i$ represents the number of crystals.

2. The silver halide light-sensitive color photographic material according to claim 1, wherein said silver halide crystals are in a form selected from the group consisting of octahedrons, tetradecahedrons, and a combination of octahedrons and tetradecahedrons.

3. The silver halide light-sensitive color photographic material according to claim 2, wherein $S/\bar{r}$ is not greater than 0.10.

4. The silver halide light-sensitive color photographic material according to claim 1, 2 or 3, wherein said compound which is capable of releasing a diffusible development inhibitor is a compound represented by the formula A-Z wherein A represents a residue capable of releasing Z upon reaction with an oxidized product of a color developing agent and Z represents a split-off residue which, upon reaction of said compound with the oxidized color developing agent, forms a development inhibitor.

5. The silver halide light-sensitive color photographic material according to claim 1, 2 or 3, wherein said compound which is capable of releasing a diffusible development inhibitor is a compound represented by the formula;

A—TIME—Z wherein A represents a residue capable of releasing Z upon reaction with an oxidized product of a color developing agent; Z represents a split-off residue which, upon reaction of said compound with the oxidized color developing agent, forms a development inhibitor; and TIME represents a divalent group capable of retarding the release of Z.

6. The silver halide light-sensitive color photographic material according to claim 5, wherein said compound is represented by formula;

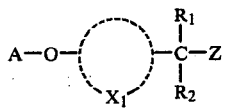

[1]

wherein $X_1$ is selected from the group consisting of a phenylene group, a substituted phenylene group, a naphthylene group and a substituted naphthylene group, and $R_1$ and $R_2$ independently represent a hydrogen atom, an alkyl group or an aryl group.

7. The silver halide light-sensitive color photographic material according to claim 5, wherein said compound is represented by formula;

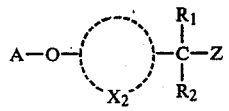

[2]

wherein $R_1$ and $R_2$ independently represent a hydrogen atom, an alkyl group or an aryl group, and $X_2$ represents a group of atoms necessary to form a divalent pyrazole-di-yl group or a divalent substituted pyrazole-di-yl group.

8. The silver halide light-sensitive color photographic material according to claim 5, wherein said compound is represented by formula;

A—Nu—Y—E—Z [3]

wherein Nu represents a nucleophilic group containing an oxygen, sulphur or nitrogen atom, Y represents a divalent group which is capable of causing under alkaline conditions, an intra-molecular nucleophilic substitution reaction by forming a three-membered or five-membered ring and thus is capable of releasing Z after the release of —Nu—Y—E—Z from A, and E represents an electrophilic group containing a carbonyl, thiocarbonyl, phosphinyl or thiophosphinyl group.

9. The silver halide light-sensitive color photographic material according to claim 1, 2 or 3 wherein said silver halide crystal is silver iodobromide.

10. The silver halide light-sensitive color photographic material according to claim 1, 2 or 3, wherein $\bar{r}$ is in the range of 0.3 to 1.5 microns.

11. A silver halide light-sensitive color photographic material which comprises a support and coated thereon (a) a blue-sensitive silver halide emulsion layer containing a yellow coupler, (b) a green-sensitive silver halide emulsion layer containing a magenta coupler and (c) a red-sensitive silver halide emulsion layer containing a cyan coupler, at least one of said blue-sensitive, green-sensitive and red-sensitive silver halide emulsion layers comprising a monodispersed silver halide emulsion containing light-sensitive negative type silver halide crystals consisting essentially of monodispersed crystals satisfying the following relationship;

$S/\bar{r} \leqq 0.15$; wherein $S = \sqrt{\Sigma(\bar{r}-r_i)^2 n_i^2/\Sigma n_i}$ and $\bar{r} = \Sigma n_i r_i/\Sigma n_i$;

and wherein S represents the standard deviation, $\bar{r}$ represents the average crystal size, $r_i$ represents the crystal size of the individual crystals and $n_i$ represents the number of crystals; and at least one of said blue-sensitive, green-sensitive and red-sensitive silver halide emulsion layers containing a compound which, upon reaction thereof with an oxidized color developing agent, is capable of releasing a diffusible development inhibitor.

12. The silver halide light-sensitive color photographic material according to claim 11, wherein each of said blue-sensitive, green-sensitive and red-sensitive silver halide emulsion layers comprise at least two layers at least one of said at least two layers having relatively high light-sensitivity and at least one of said at least two layers having relatively low light-sensitivity.

13. The silver halide light-sensitive color photographic material according to claim 11 or 12, wherein $S/\bar{r}$ is not greater than 0.10.

14. The silver halide light-sensitive color photographic material according to claim 12, wherein said compound is incorporated in at least one of the relatively low light-sensitive layers.

15. The silver halide light-sensitive color photographic material according to claim 11 or 12, wherein said compound is incorporated in the green-sensitive silver halide emulsion layer.

16. The silver halide light-sensitive color photographic material according to claim 11, wherein said compound is incorporated into each of said blue-sensitive, green-sensitive and red-sensitive silver halide emulsion layers.

17. The silver halide light-sensitive color photographic material according to claim 12, wherein said compound is incorporated into each of said blue-sensitive, green-sensitive and red-sensitive silver halide emulsion layers.

18. The silver halide light-sensitive color photographic material according to claim 11, 12, 16 or 17, wherein said crystals are in a form selected from octahedrons tetradecahedrons, and a combination of octahedrons and tetradecahedrons.

19. The silver halide light-sensitive color photographic material according to claim 11 wherein $\bar{r}$ is in the range of 0.3 to 1.5 microns.

20. The silver halide light-sensitive color photographic material according to claim 13 wherein $\bar{r}$ is in the range of 0.3 to 1.5 microns.

* * * * *

UNITED STATES PATENT AND TRADEMARK OFFICE

CERTIFICATE OF CORRECTION

PATENT NO. : 4,461,826

DATED : July 24, 1984

INVENTOR(S) : Kiyoshi YAMASHITA et al

It is certified that error appears in the above-identified patent and that said Letters Patent is hereby corrected as shown below:

Title page, right column, in the ABSTRACT, 7th line from end, replace the following formula " $$S = \frac{\sqrt{\Sigma(\bar{r} - r_i)^2 n_i^2}}{\Sigma n_i}$$ "

with -- $$S = \sqrt{\frac{\Sigma(\bar{r} - r_i)^2 n_i}{\Sigma n_i}}$$ -- .

Column 2, line 46, replace the formula with the following formula

-- $$S = \sqrt{\frac{\Sigma(\bar{r} - r_i)^2 n_i}{\Sigma n_i}}$$ -- .

UNITED STATES PATENT AND TRADEMARK OFFICE

CERTIFICATE OF CORRECTION

PATENT NO. : 4,461,826

DATED : July 24, 1984

INVENTOR(S) : Kiyoshi YAMASHITA et al

It is certified that error appears in the above-identified patent and that said Letters Patent is hereby corrected as shown below:

Column 4, between lines 5 and 10, replace the formula with the following formula $$-- \quad S = \sqrt{\frac{\Sigma(\bar{r} - r_i)^2 \, n_i}{\Sigma n_i}} \quad --.$$

Column 25, bottom formula, left side, "$C_{18}$" should be --$C_{13}$--.

Column 60, line 42, replace the formula with the following formula $$-- \quad S = \sqrt{\frac{\Sigma(\bar{r} - r_i)^2 \, n_i}{\Sigma n_i}} \quad --.$$

UNITED STATES PATENT AND TRADEMARK OFFICE

CERTIFICATE OF CORRECTION

PATENT NO. : 4,461,826

DATED : July 24, 1984

INVENTOR(S) : Kiyoshi YAMASHITA et al

It is certified that error appears in the above-identified patent and that said Letters Patent is hereby corrected as shown below:

Column 62, line 3 (Claim 8), after "causing" insert --,--.

Column 62, line 30, replace the following formula

" $$S = \frac{\sqrt{\Sigma(\bar{r} - r_i)^2 n_i^2}}{\Sigma n_i}$$ "

with -- $$S = \sqrt{\frac{\Sigma(\bar{r} - r_i)^2 n_i}{\Sigma n_i}}$$ --.

Signed and Sealed this

Twenty-first Day of October, 1986

[SEAL]

*Attest:*

DONALD J. QUIGG

*Attesting Officer* *Commissioner of Patents and Trademarks*